US008909101B2

(12) United States Patent
Shirakata

(10) Patent No.: US 8,909,101 B2
(45) Date of Patent: Dec. 9, 2014

(54) IMAGE FORMING APPARATUS WITH CONTROL OF STEERING ROLLER FOR ADJUSTING POSITION OF BELT MEMBER ON WHICH IMAGE IS FORMED

(75) Inventor: Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 485 days.

(21) Appl. No.: 13/249,682

(22) Filed: Sep. 30, 2011

(65) Prior Publication Data

US 2012/0082489 A1 Apr. 5, 2012

(30) Foreign Application Priority Data

Oct. 1, 2010 (JP) ..... 2010-224329

(51) Int. Cl.
*G03G 15/00* (2006.01)
*G03G 15/01* (2006.01)
*G03G 15/16* (2006.01)

(52) U.S. Cl.
CPC ..... *G03G 15/1615* (2013.01); *G03G 15/0189* (2013.01); *G03G 15/0131* (2013.01)
USPC ..... 399/165; 399/395

(58) Field of Classification Search
USPC ..... 399/165, 302, 388, 394, 395
See application file for complete search history.

(56) References Cited

U.S. PATENT DOCUMENTS

| | | | | |
|---|---|---|---|---|
| 6,895,210 | B1 * | 5/2005 | Quesnel | 399/395 |
| 2008/0056790 | A1 * | 3/2008 | Maruyama | 399/395 |
| 2008/0232878 | A1 * | 9/2008 | Sekine et al. | 399/395 |
| 2009/0180805 | A1 * | 7/2009 | Nakura et al. | 399/165 |
| 2011/0227279 | A1 | 9/2011 | Shirakata | |
| 2011/0311240 | A1 | 12/2011 | Shirakata | |

FOREIGN PATENT DOCUMENTS

JP 2000-264479 9/2000

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An image forming apparatus includes a belt member; a toner image forming portion for forming a toner image on the belt member; a transfer portion where the toner image formed on the belt member is to be transferred onto a recording material; a recording material supplying portion for supplying the recording material to the transfer portion; a steering portion for adjusting a widthwise position of the belt member by being tilted; and an adjusting portion for adjusting a conveyance direction of the recording material supplied by the recording material supplying portion so that a conveyance direction of the belt member when the steering portion is tilted is the same as the conveyance direction of the recording material supplied by the recording material supplying portion.

11 Claims, 19 Drawing Sheets

(a)

(b)

(a)

(b)

(a)

(b)

(a)

(b)

(a)

(b)

(a) CONDITION FOR NON-SLIP(F:+)

(b) CONDITION FOR NON-SLIP(F:−)

(a) CONDITION FOR NON-SLIP(F:＋)

(b) CONDITION FOR NON-SLIP(F:－)

(a)

(b)

IMAGE FORMING APPARATUS WITH CONTROL OF STEERING ROLLER FOR ADJUSTING POSITION OF BELT MEMBER ON WHICH IMAGE IS FORMED

FIELD OF THE INVENTION AND RELATED ART

The present invention relates to an image forming apparatus in which a toner image is transferred onto a recording material by using a belt member subjected to steering control. Specifically, the present invention relates to a mechanism for reducing a transfer image distortion generated with the steering control.

The image forming apparatus in which the toner image is transferred onto the recording material while effecting lateral belt deviation control (steering control) of a belt member (intermediary transfer belt, recording material conveyer belt, transfer belt or photosensitive member belt). In the lateral belt deviation control, a rotational position of the belt member, with respect to a widthwise direction, which is supported by a plurality of rotatable supporting members and is rotated is detected. Then, on the basis of a detection result, the belt member is moved in an axial direction of the rotatable supporting members by tilting a steering roller for supporting an inner surface of the belt member, so that the rotational position of the belt member with respect to the widthwise direction is controlled.

Japanese Laid-Open Patent Application (JP-A 2000-264479 discloses an image forming apparatus in which the toner image is transferred onto the recording material by using the intermediary transfer belt subjected to the lateral belt deviation control. In the image forming apparatus, an object to be solved is that disturbance occurs in the steering control of the intermediary transfer belt when a transfer roller or a cleaning device is contacted to and separated from the intermediary transfer belt. When the transfer roller or the cleaning device is contacted to and separated from the intermediary transfer belt, the steering control is effected on the assumption that the disturbance occurs, so that the intermediary transfer belt is prevented from moving unstably.

In the image forming apparatus in which the recording material is transferred onto the recording material by using the belt member, it was turned out that the recording material to be supplied to the transfer portion also constitutes the disturbance in the steering control of the belt member.

As shown in FIG. 1, in the image forming apparatus using an intermediary transfer belt 606, a registration roller 65 is provided in front of a secondary transfer portion T2 and the recording material nip-conveyed by the registration roller 65 is delivered to the steering portion T2 to be nip-conveyed. In this case, when there is a deviation of an angle between a conveyance direction of the intermediary transfer belt 606 and a conveyance direction of the recording material by the registration roller 65, the lateral belt deviation control of the intermediary transfer belt 606 is constrained by the recording material nip-conveyed by the registration roller 65 and is subjected to disturbance.

In the image forming apparatus described in JP-A 2000-264479, the conveyance direction of the intermediary transfer belt 606 is not changed by the steering control (FIG. 14) but is actually changed depending on a tilting state of the steering roller (FIG. 15). For this reason, depending on the tilting state of the steering roller, a direction and magnitude of the disturbance when the recording material is nipped at the steering portion T2 are also changed, so that the disturbance cannot be suppressed by the method description in JP-A 2000-264479.

Further, as shown in FIG. 10, in a particular tilting state, it was turned out that slip is generated at an image surface due to deviation between the belt member conveyance direction and the recording material supply direction to create transfer image distortion.

SUMMARY OF THE INVENTION

A principal object of the present invention is to provide an image forming apparatus capable of reducing a degree of deviation between a belt member conveyance direction and a recording material supply direction.

According to an aspect of the present invention is to provide an image forming apparatus comprising:

a belt member;

toner image forming means for forming a toner image on the belt member;

a transfer portion where the toner image formed on the belt member is to be transferred onto a recording material;

recording material supplying means for supplying the recording material to the transfer portion;

steering means for adjusting a widthwise position of the belt member by being tilted; and adjusting means for adjusting a conveyance direction of the recording material supplied by the recording material supplying means so that a conveyance direction of the belt member when the steering means is tilted is the same as the conveyance direction of the recording material supplied by the recording material supplying means.

These and other objects, features and advantages of the present invention will become more apparent upon a consideration of the following description of the preferred embodiments of the present invention taken in conjunction with the accompanying drawings.

Figure 3:
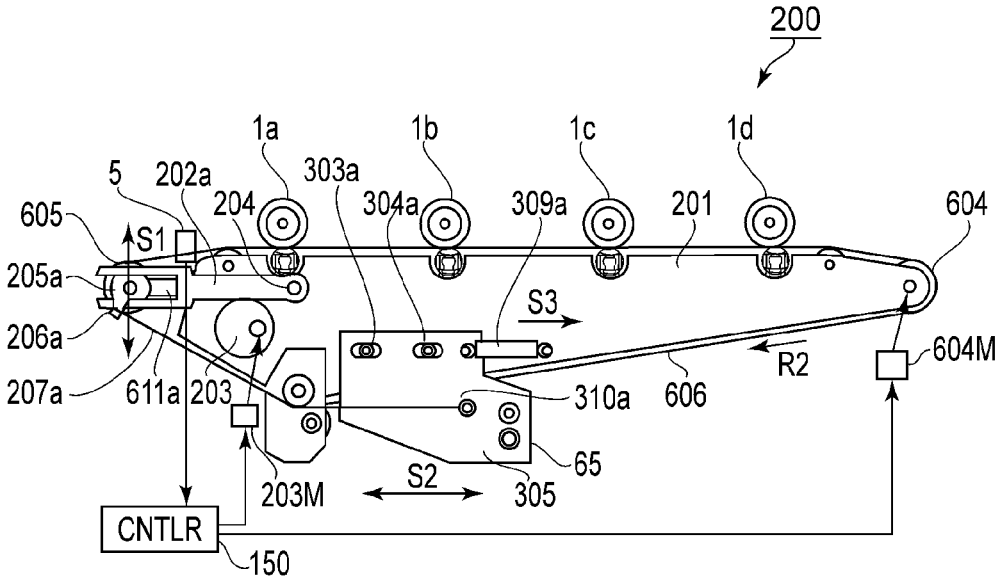
Figure 3:
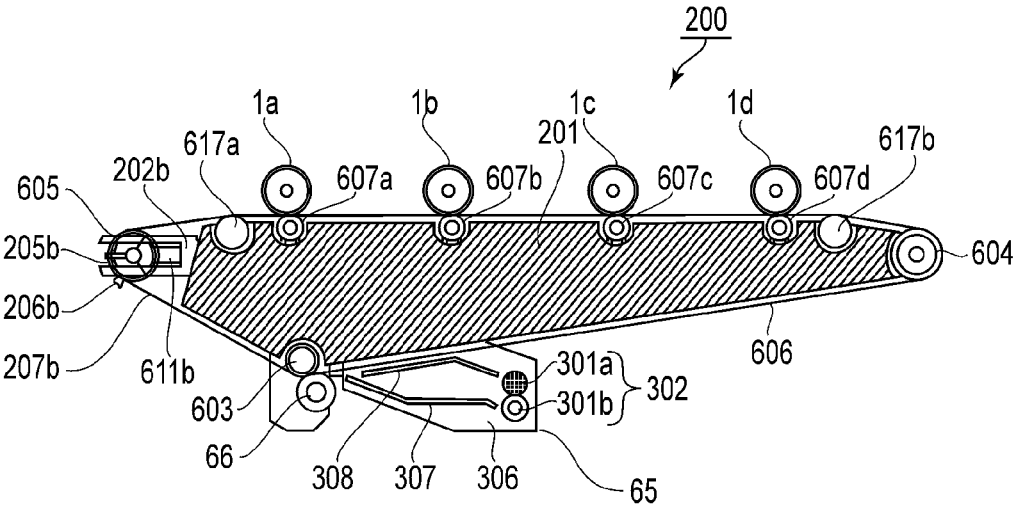

Parts (a) and (b) of FIG. 3 are illustrations of a structure of the intermediary transfer belt unit.

Figure 4:
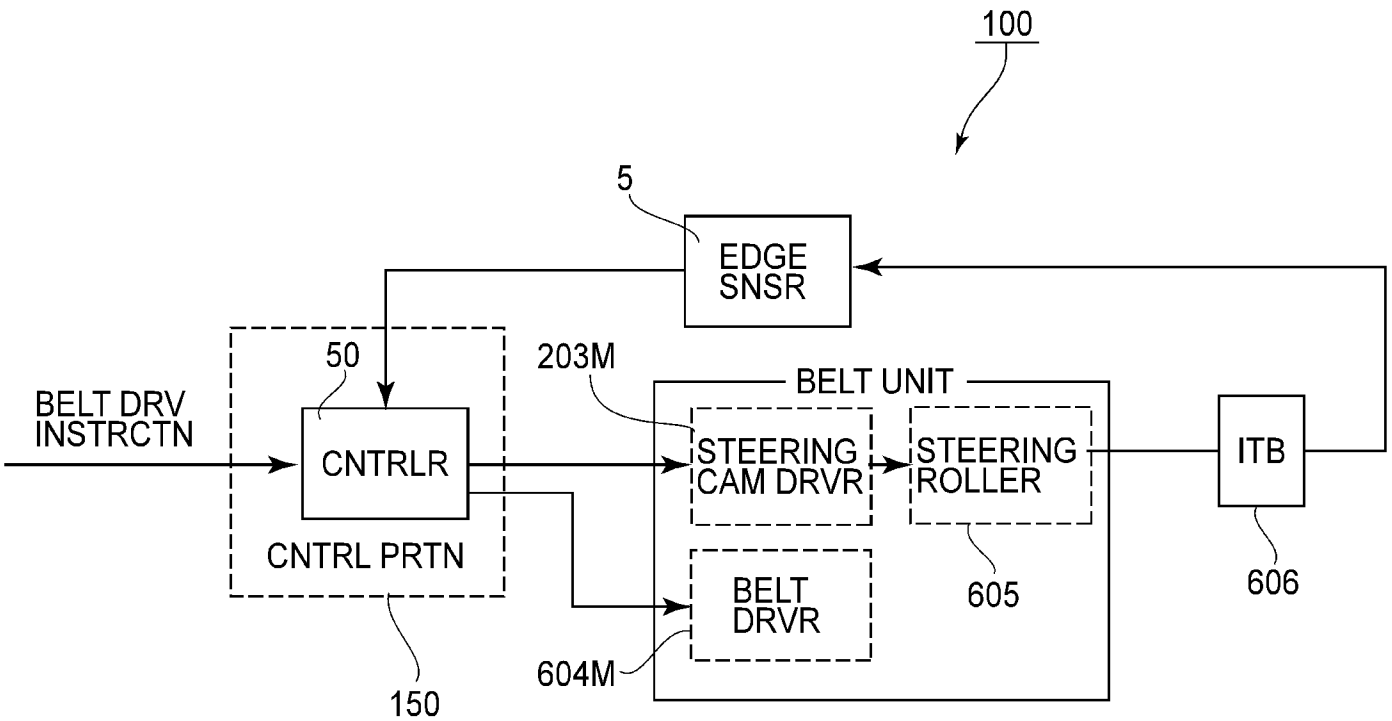

FIG. 4 is a block diagram of a constitution of lateral belt deviation control.

Figure 5:
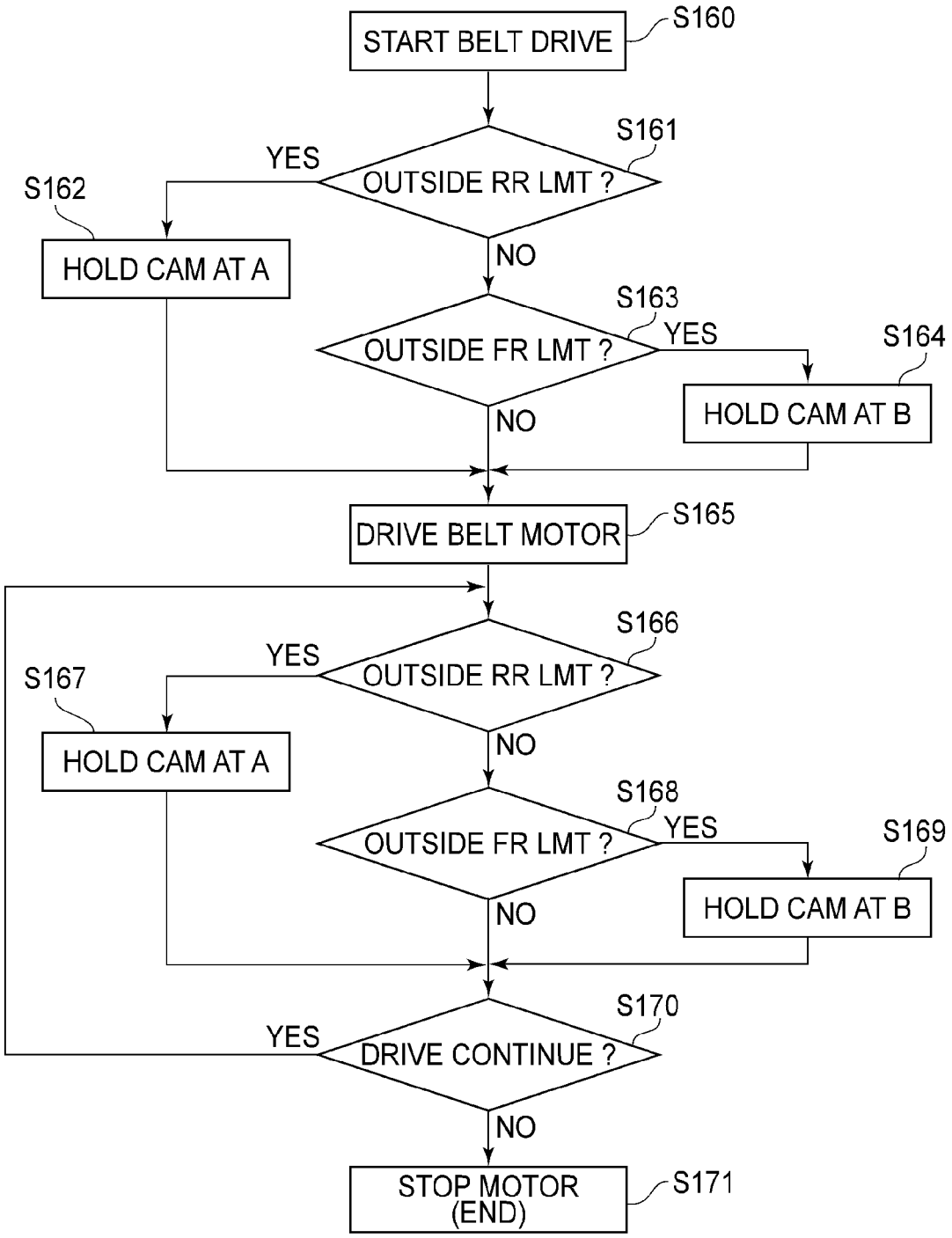

FIG. 5 is a flow chart of the lateral belt deviation control.

Figure 6:
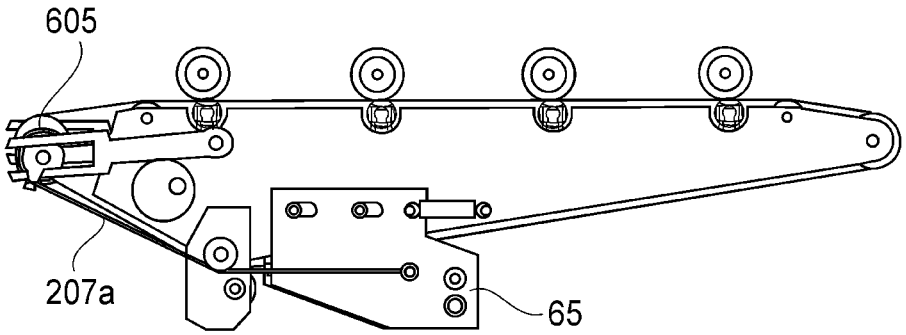
Figure 6:
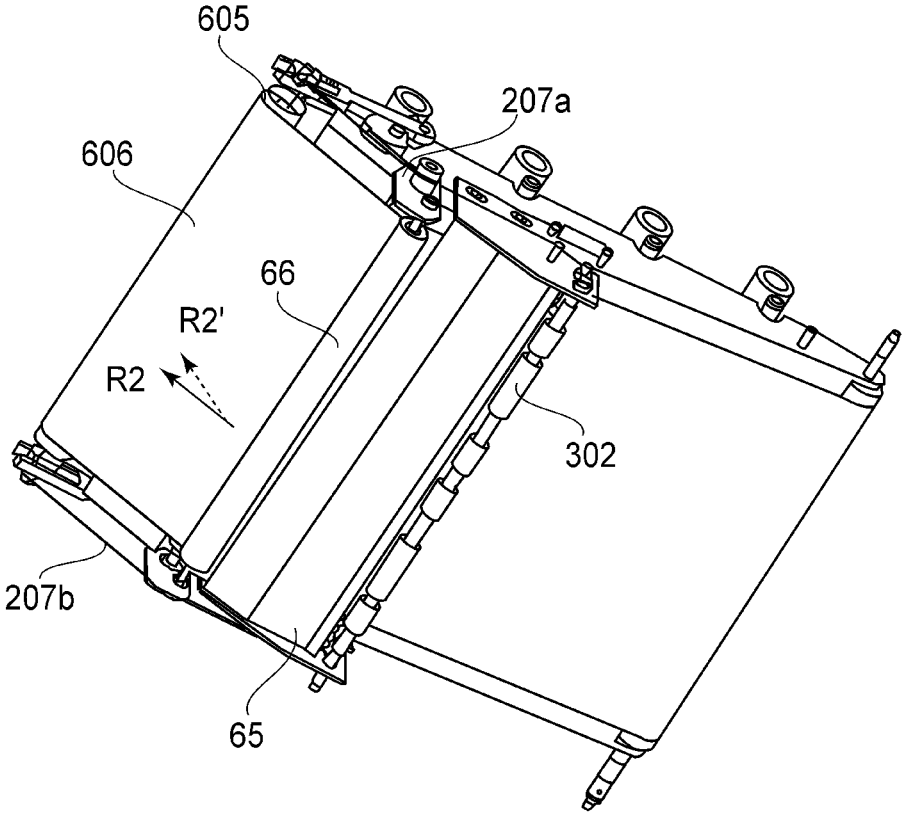

Parts (a) and (b) of FIG. 6 are illustrations of a first cam position.

Figure 7:
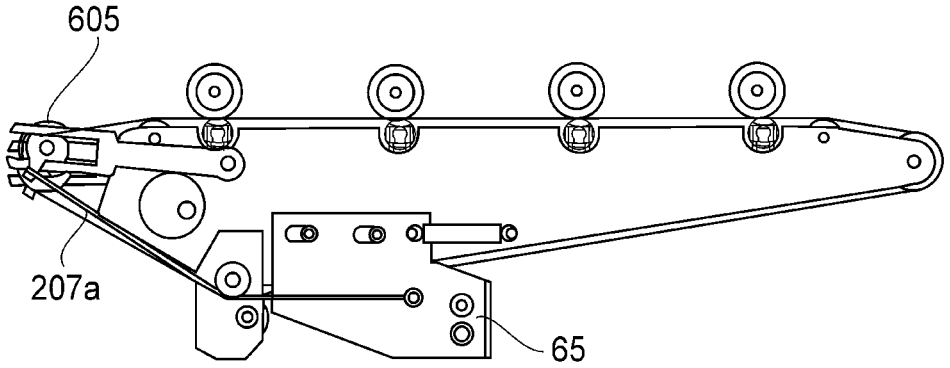
Figure 7:
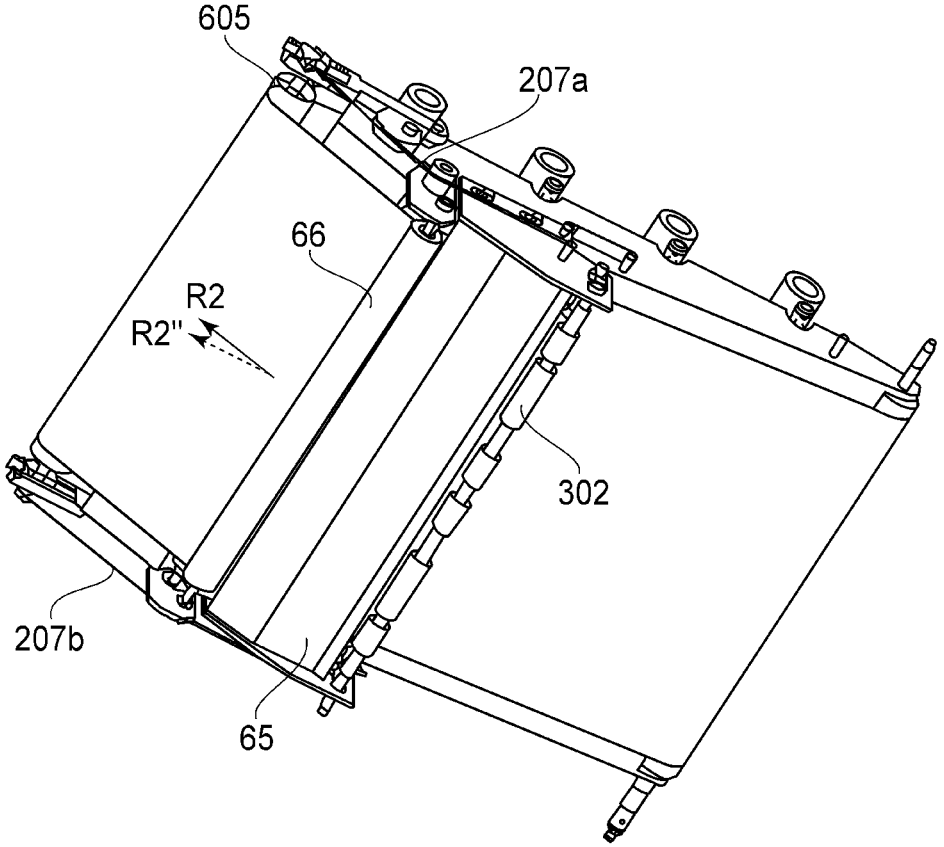

Parts (a) and (b) of FIG. 7 are illustrations of a second cam position.

Figure 8:
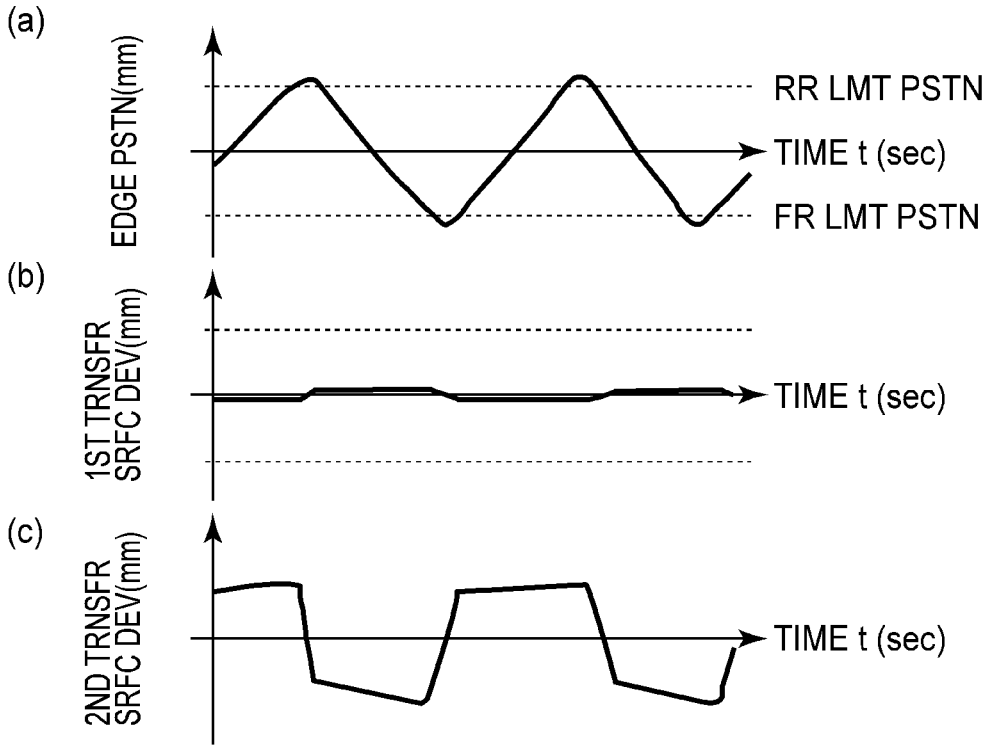

Parts (a), (b) and (c) of FIG. 8 are illustrations of a rotation state of the intermediary transfer belt subjected to the lateral belt deviation control.

Figure 9:
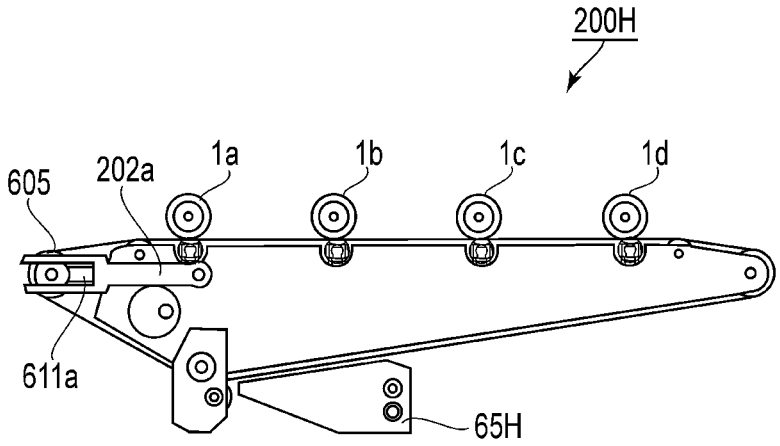

FIG. 9 is an illustration of a structure of an intermediary transfer belt unit in Comparative Embodiment.

Figure 10:
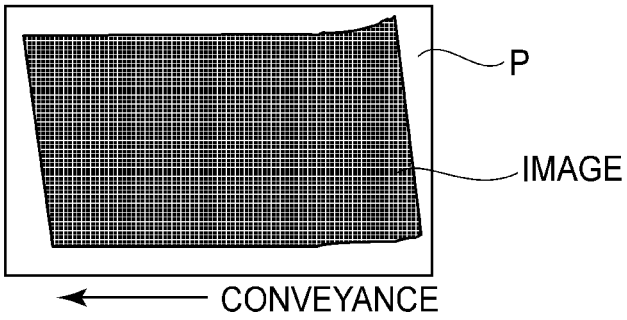
Figure 10:
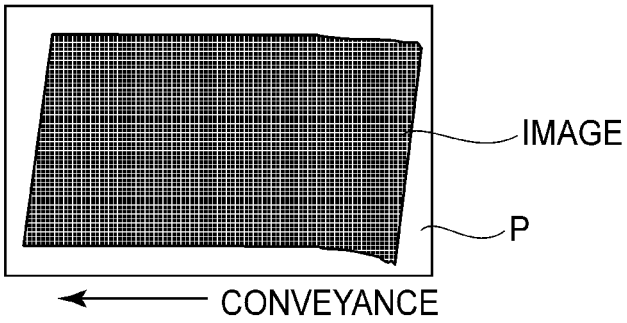

Parts (a) and (b) of FIG. 10 are illustrations of transfer image disturbance in Comparative Embodiment.

Figure 11:
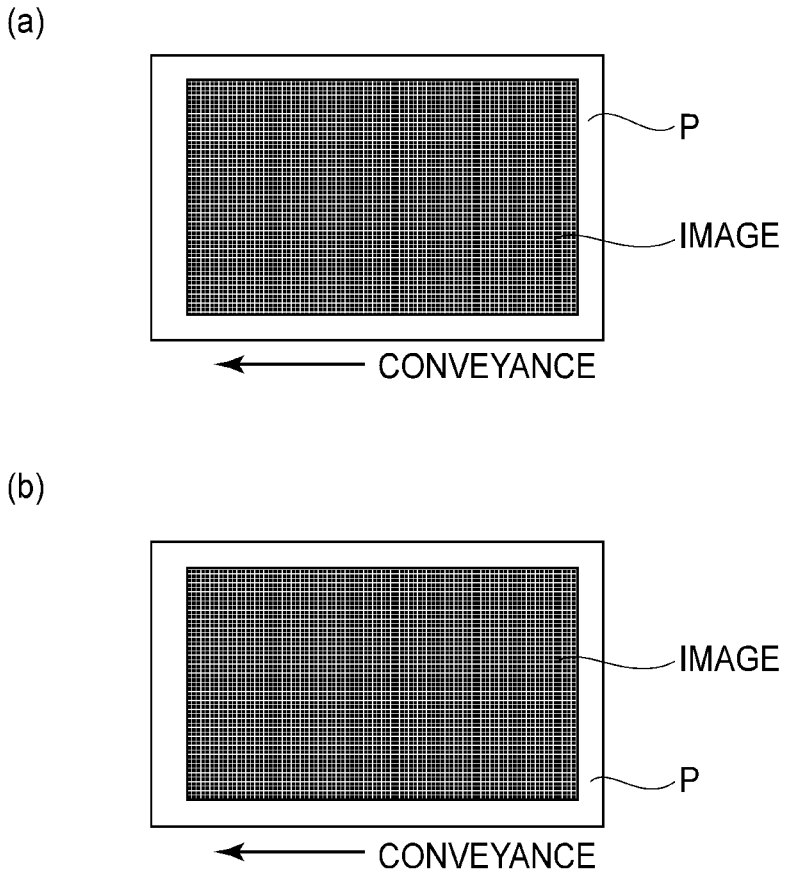

Parts (a) and (b) of FIG. 11 are illustrations of elimination of the transfer image disturbance in Embodiment 1.

Figure 12:
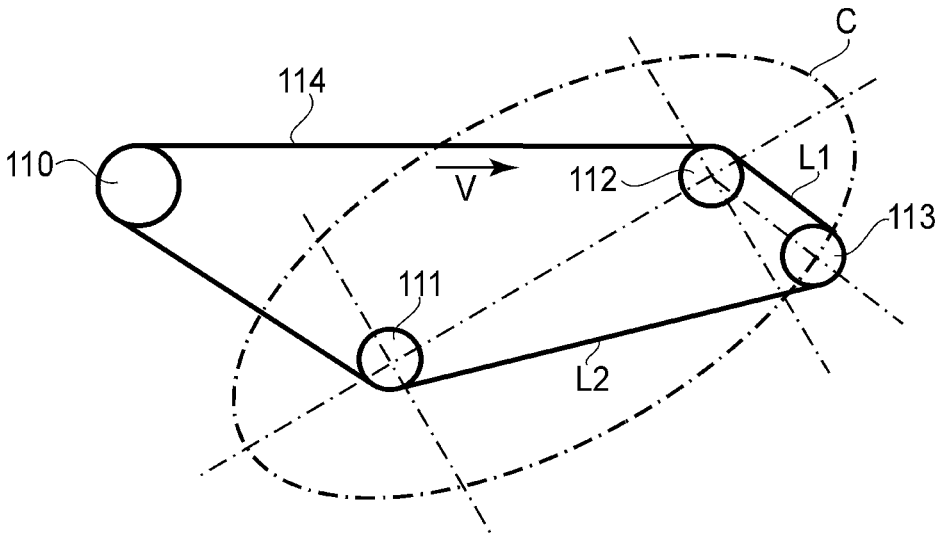

FIG. 12 is an illustration of a locus of an end portion of a steering roller with tilting.

Figure 13:
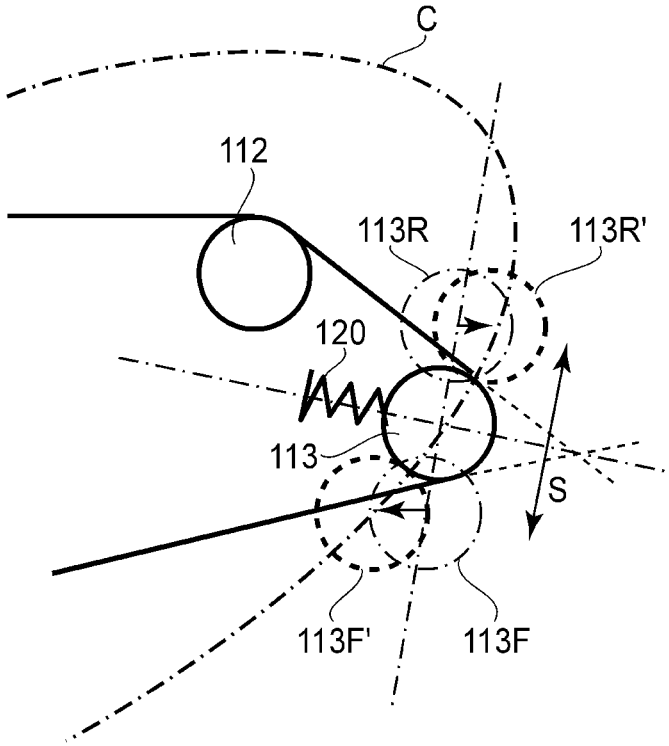

FIG. 13 is an enlarged view of the locus of the steering roller end portion.

Figure 14:
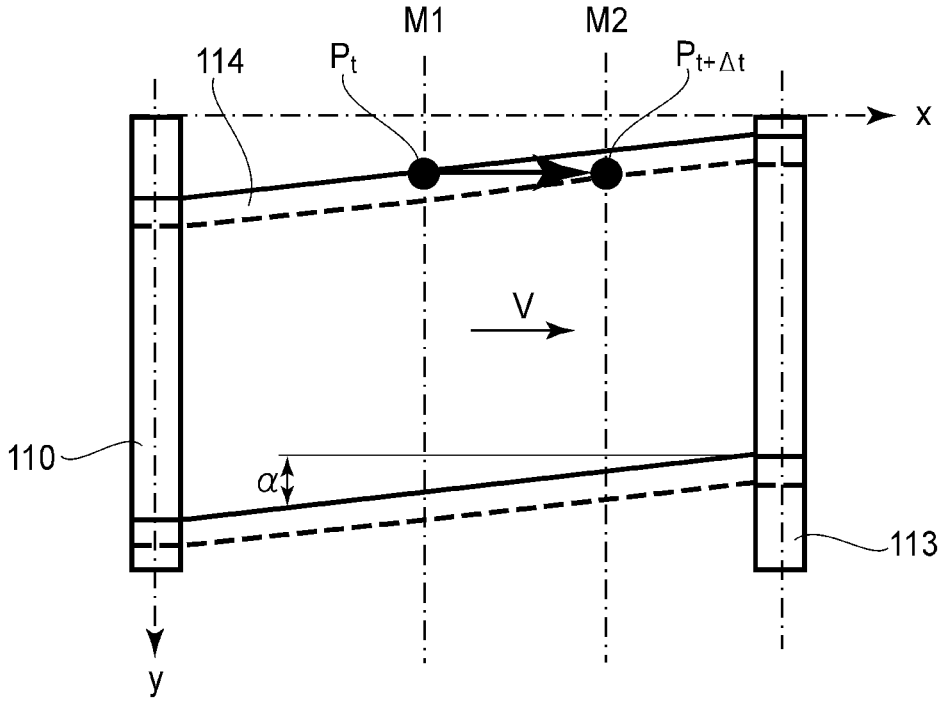

FIG. 14 is an illustration of an ideal belt movement direction.

Figure 15:
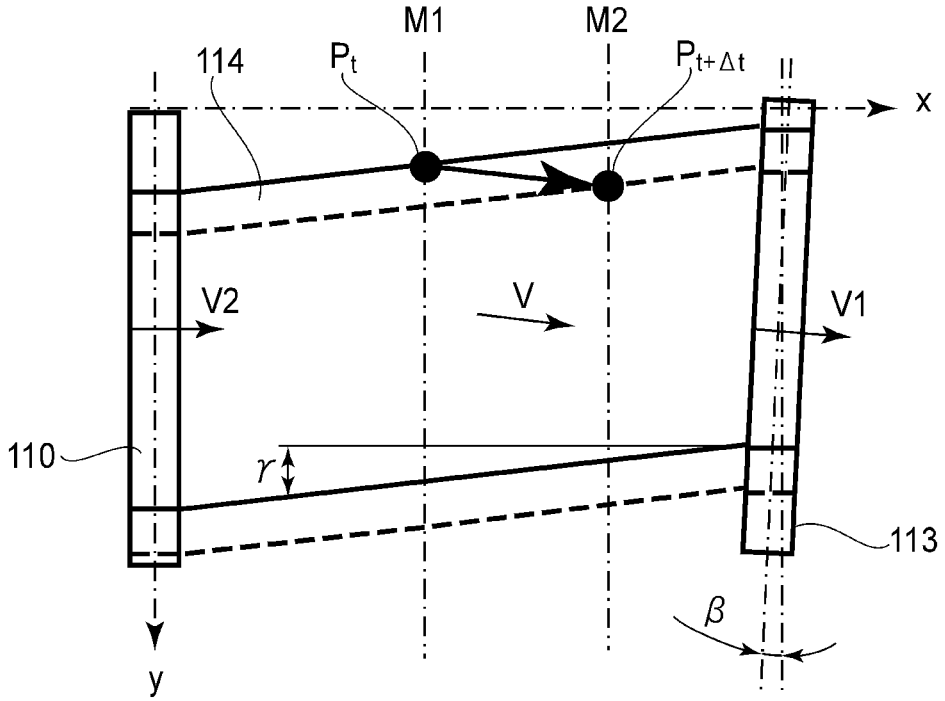

FIG. 15 is an illustration of an actual belt movement direction.

Figure 16:
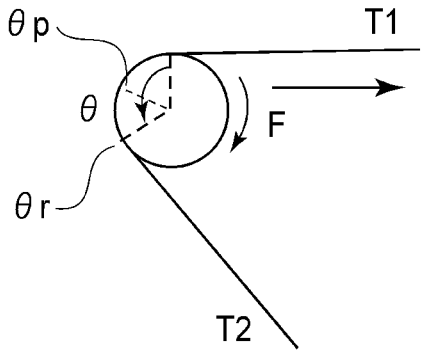

FIG. 16 is an illustration of a belt winding state about the steering roller.

Figure 17:
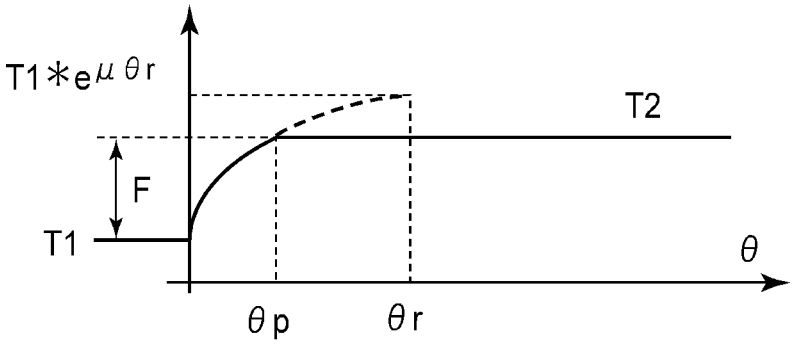
Figure 17:
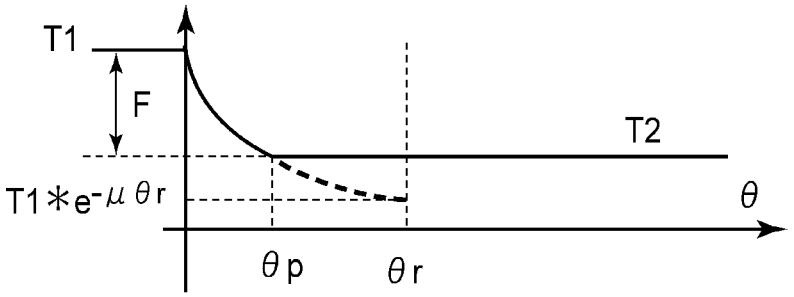

Parts (a) and (b) of FIG. 17 are illustrations of a non-slip condition between the steering roller and the belt.

Figure 18:
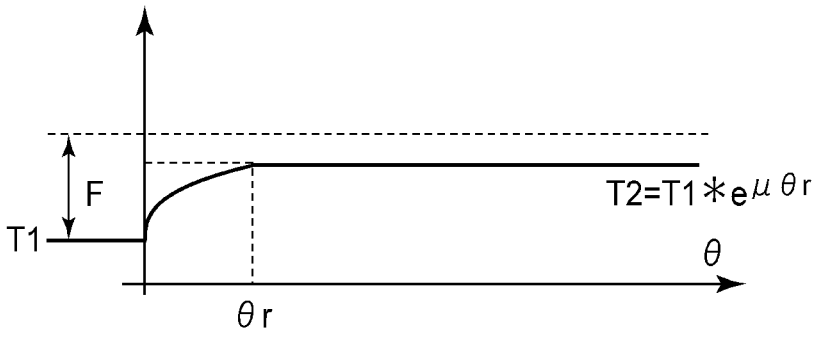
Figure 18:
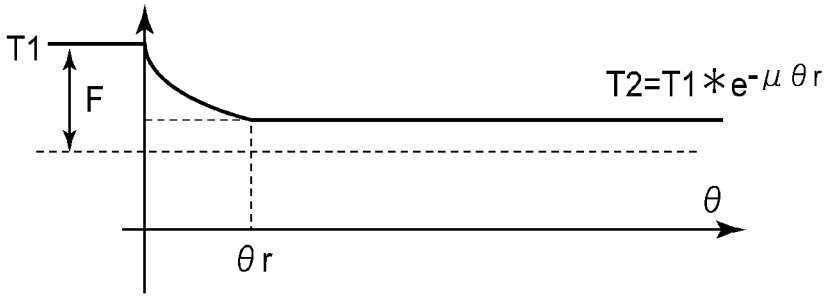

Parts (a) and (b) of FIG. 18 are illustrations of a slip condition between the steering roller and the belt.

Figure 19:
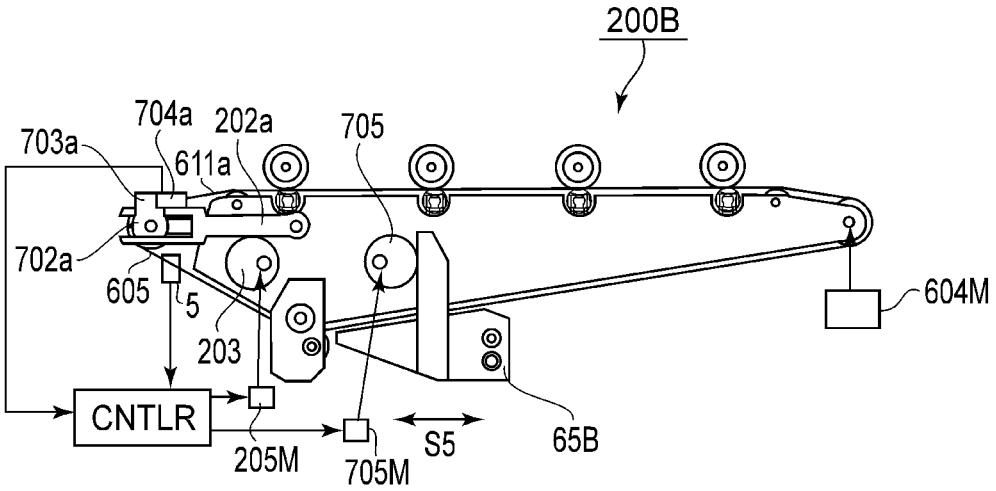
Figure 19:
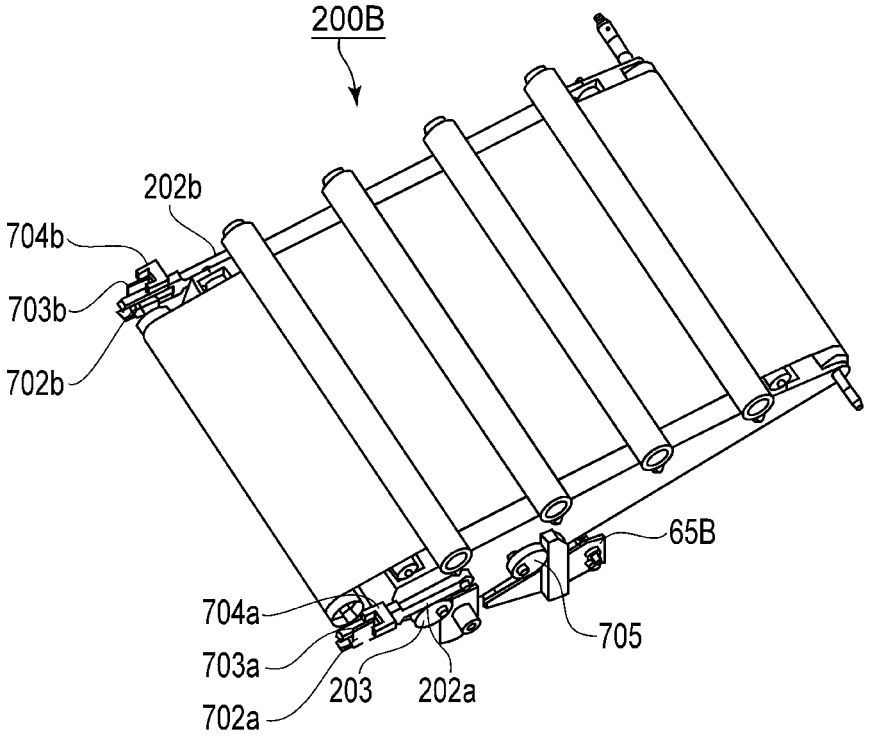

Parts (a) and (b) of FIG. 19 are illustrations of an intermediary transfer belt unit in Embodiment 2.

Figure 20:
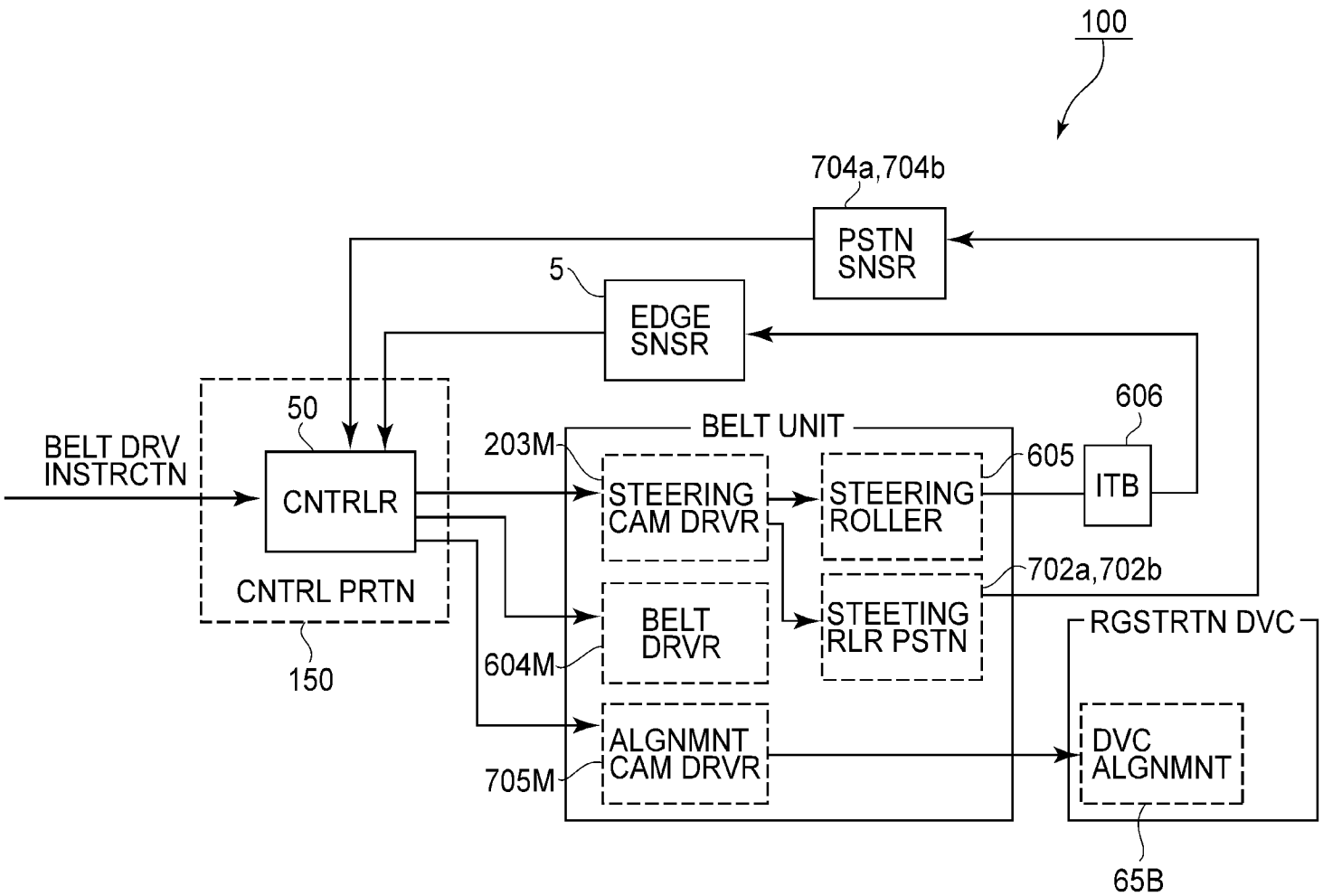

FIG. 20 is a block diagram of a lateral belt deviation control constitution in Embodiment 2.

Figure 21:
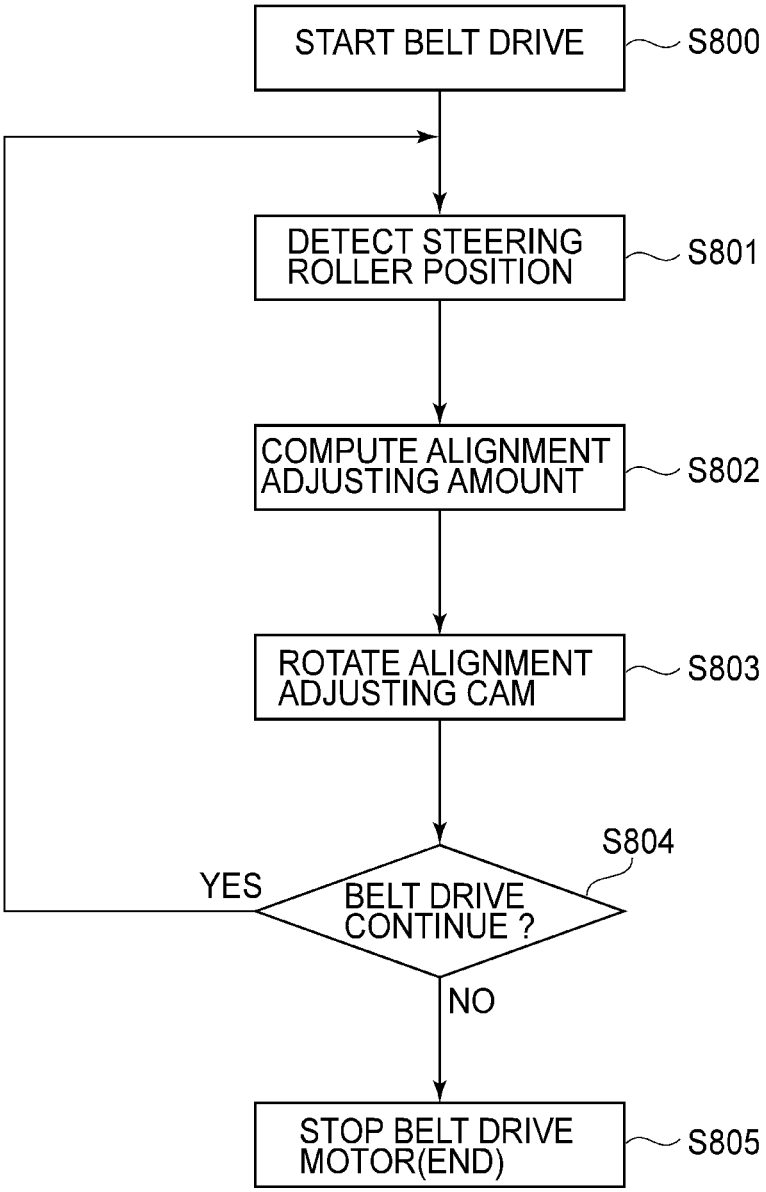

FIG. 21 is a flow chart of the lateral belt deviation control in Embodiment 2.

Figure 22:
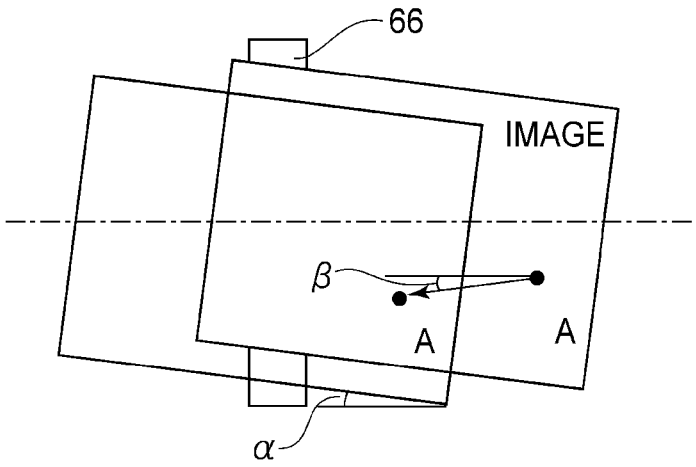

FIG. 22 is an illustration of a parameter with respect to a belt conveyance direction.

Figure 23:
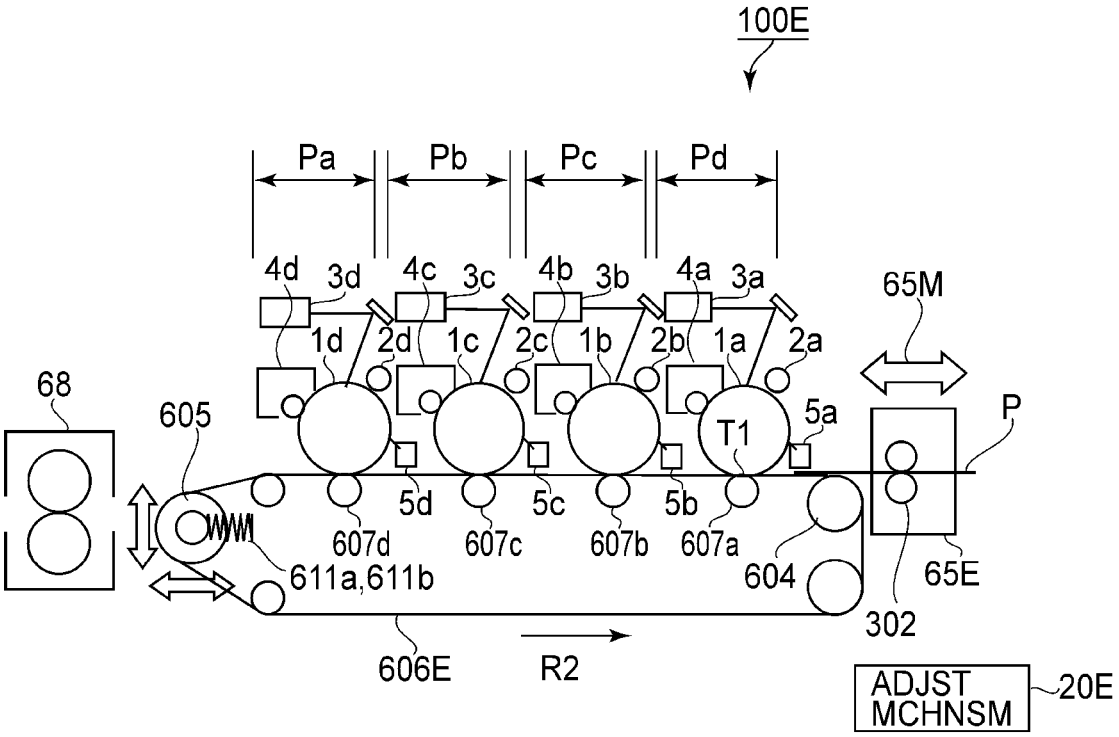

FIG. 23 is an illustration of a structure of an image forming apparatus in Embodiment 3.

Figure 24:
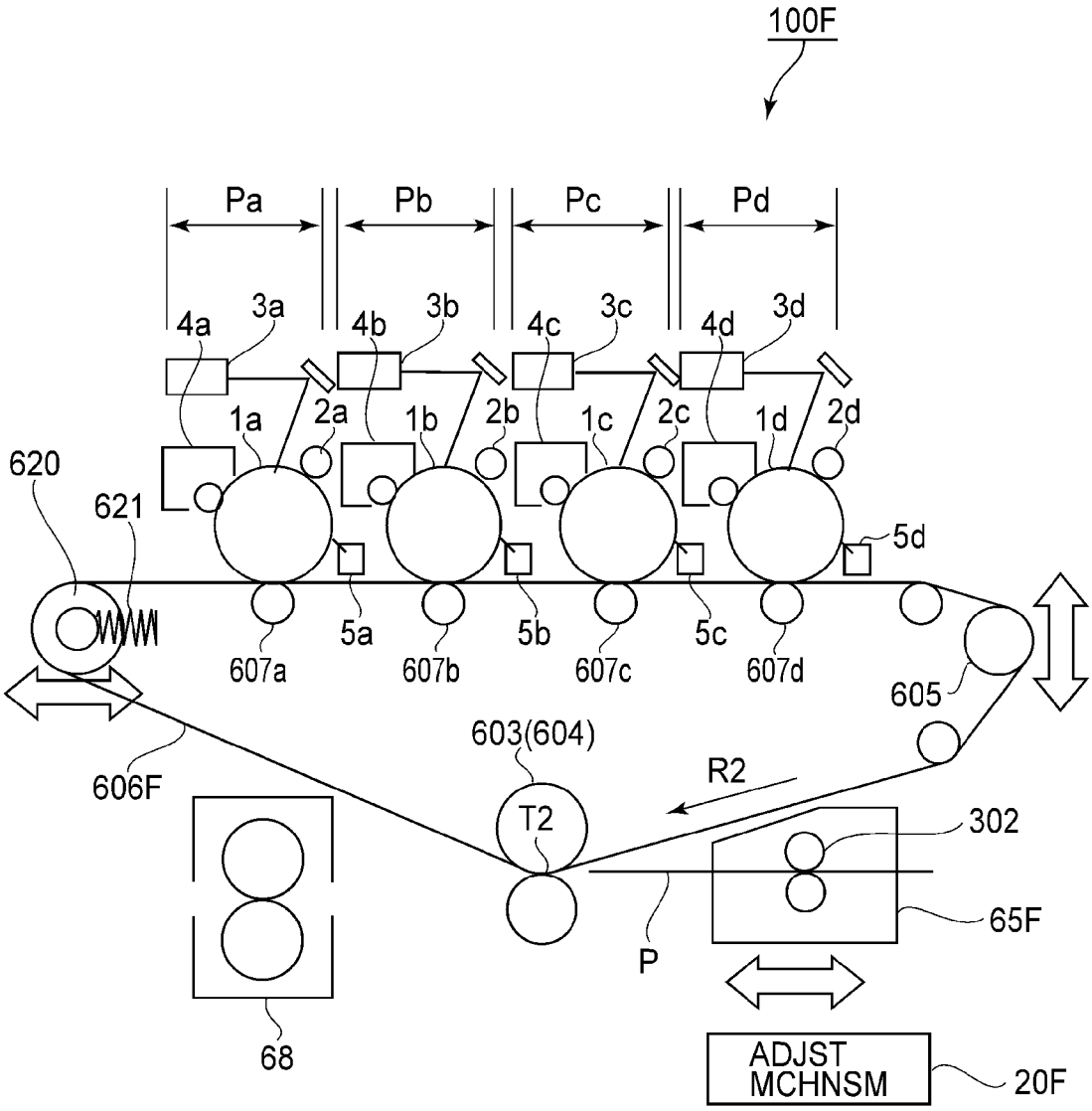

FIG. 24 is an illustration of a structure of an image forming apparatus in Embodiment 4.

DESCRIPTION OF THE PREFERRED EMBODIMENTS

Embodiments of the present invention will be described in detail with reference to the drawings. The present invention can also be carried out in other embodiments in which a part or all of constituent elements are replaced with alternative constituent elements so long as a conveyance direction of a recording material is adjusted depending on a degree of tilting of a steering roller constrained by a belt member.

Therefore, the present invention can also be carried out by not only an image forming apparatus using an intermediary transfer belt but also an image forming apparatus using a recording material conveyer belt, a transfer belt or a photosensitive member belt. Further, the present invention can be carried out irrespective of its types such as a tandem type and one-drum type and its modes such as a monochromatic mode and a full-color mode.

In this embodiment, only a principal portion relating to toner image formation and transfer will be described but the present invention can be carried out in image forming apparatuses in various fields, such as printers, various printing machine, copying machines, facsimile machines and multifunction machines by additionally providing necessary device, equipment and casing structure.

<Image Forming Apparatus>

Figure 1:
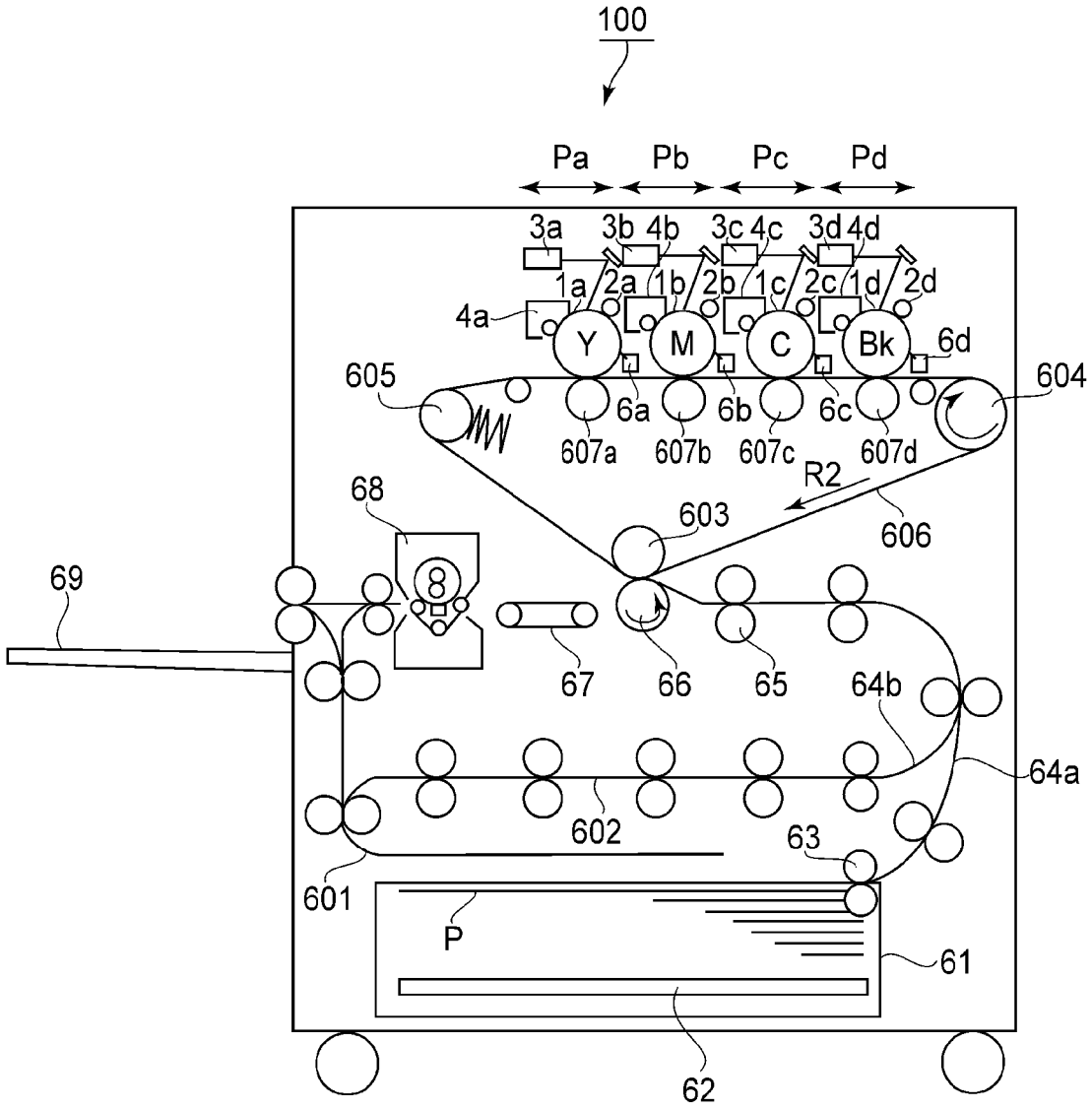
FIG. 1 is an illustration of a structure of an image forming apparatus.

FIG. 1 is an illustration of a structure of an image forming apparatus. The type of the image forming apparatus may include a plurality of types such as an electrophotographic type, an offset printing type and an ink jet type but is the electrophotographic type in this embodiment.

As shown in FIG. 1, the image forming apparatus 100 is an intermediary transfer type full-color printer of the tandem type in which image forming portions Pa for yellow (Y), Pb for magenta (M), Pc for cyan (C) and Pd by black (Bk) are juxtaposed along an intermediary transfer belt 606. This type of the image forming apparatus goes mainstream in recent years from the viewpoints of compatibility with various media and an advantage of high productivity.

At the image forming portion Pa, a yellow toner image is formed on a photosensitive drum 1*a* and then is transferred onto the intermediary transfer belt 606. At the image forming portion Pb, a magenta toner image is formed on a photosensitive drum 1*b* and then is transferred onto the intermediary transfer belt 606. At the image forming portions Pc and Pd, a cyan toner image and a black toner image are formed on photosensitive drums 1*c* and 1*d* and then are transferred onto the intermediary transfer belt 606.

A recording material P is stacked on a lift-up device 62 in a recording material accommodating portion (cassette) 61 and is fed by a sheet feeding roller 63 in synchronism with image formation timing. The recording material P fed by the sheet feeding roller 63 passes through a conveying path 64*a* and is conveyed to a registration device 65. The registration device 65 sends, after effecting oblique movement correction and timing correction of the recording material P, the recording material P to a steering portion T2. The secondary transfer portion T2 is a transfer portion where the toner image is transferred from the intermediary transfer belt 606 onto the recording material P, and a nip is formed between an outer secondary transfer roller 66 and the intermediary transfer belt 606 through which an inner secondary transfer roller 603 opposes the outer secondary transfer roller 66. In the nip of the secondary transfer portion T2, the toner image on the intermediary transfer belt 606 is transferred onto the recording material P under application of predetermined pressure and bias voltage. The recording material P on which the toner image is transferred is attracted by a conveyer belt 67 and is conveyed to a fixing device 68. The recording material P is subjected to heat-pressing by the fixing device 68, so that the toner image is fixed on the surface of the recording material P and then the recording material P is discharged onto a tray 63 outside the image forming apparatus 100.

In the case of both side (surface) image formation, leading and trailing ends of the recording material P sent to a reverse conveying device 601 are replaced by a switch-back operation to be conveyed to a both side conveying device 602. Thereafter, the recording material P is conveyed through a sheet feeding path 65*b* to enter the conveying path to be sent to the steering portion T2 again.

Each of the image forming processes for respective colors performed in parallel at the image forming portions Pa, Pb, Pc and Pd is carried out with timing of superposition on the upstream-side toner image which has been primary-transferred on the intermediary transfer belt 606. The image forming portions Pa, Pb, Pc and Pd have the substantially same constitution except that the colors of the toners used in developing devices 4*a*, 4*b*, 4*c* and 4*d* are different from each other. In the following, the image forming portion Pa is described but other image forming portions Pb, Pc and Pd are similarly applied by reading suffix a of parts (elements) of the image forming portion Pa as b, c and d of those of the image forming portions Pb, Pc and Pd, respectively.

The image forming portion Pa includes, around the photosensitive drum 1*a*, a charging roller 2*a*, an exposure device 3*a*, the developing device 4*a*, a primary transfer roller 607*a* and a drum cleaning device 6*a*. The photosensitive drum 1*a* has a photosensitive layer, having a negative charge polarity, formed at an outer peripheral surface of an aluminum cylinder and rotates in an arrow R1 direction at a predetermined process speed. The charging roller 2*a* scans the surface of the photosensitive drum 1*a* with a laser beam through a rotating mirror to write (form) an electrostatic image for an image on the charged surface of the photosensitive drum 1*a*. The developing device 4*a* develops the electrostatic image on the surface of the photosensitive drum 1*a* with a developer containing the toner and a carrier, so that the toner image is formed.

The primary transfer roller 607*a* urges an inside surface of the intermediary transfer belt 606 to form a primary transfer portion T1 between the photosensitive drum 1*a* and the intermediary transfer belt 606. By applying a positive DC voltage to the primary transfer roller 607*a*, the negative toner image carried on the photosensitive drum 1*a* is primary-transferred onto the intermediary transfer belt 606. The drum cleaning device 6*a* collects transfer residual toner remaining on the photosensitive drum 1*a* without being transferred onto the recording material P.

Incidentally, in the image forming apparatus, inclusive of the intermediary transfer belt on which secondary transfer surface of the respective color toner images are superposed to form a full-color image, various other belt conveying mechanisms. In each belt conveying mechanism, due to an alignment error or the like of a rotatable supporting member for stretching the belt member, lateral belt deviation (shift) which is widthwise belt displacement occurs with belt conveyance. When the lateral belt deviation is left, the belt member is laterally shifted to an outside of a supporting range of the rotatable supporting member to cause breakage and disengagement thereof. For this reason, a roller steering method in which the lateral belt deviation is corrected by changing a degree of alignment of the rotatable supporting member for supporting an inner peripheral surface of the belt member is employed.

The roller steering method can cause the deviation (shift) of the belt member to fall within the supporting range of the rotatable supporting member without applying a stress to the belt member by properly and timely controlling a steering amount of steering roller. For that reason, in the image forming apparatus with high productivity which is required to possess durability, a lateral belt deviation correcting mechanism of the roller steering type is frequently used.

<Intermediary Transfer Belt Unit>

Figure 2:
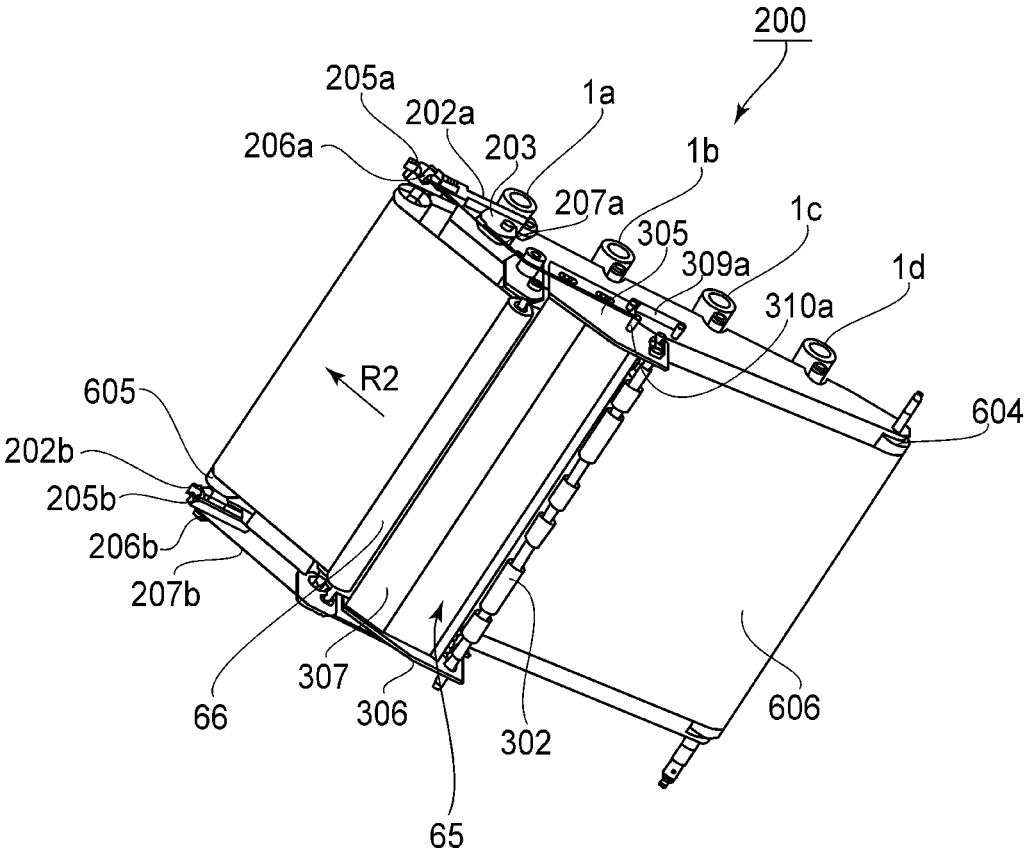
FIG. 2 is a perspective view of an intermediary transfer belt unit.

FIG. 2 is a perspective view of an intermediary transfer belt unit. FIG. 3 is an illustration of a structure of the intermediary transfer belt unit wherein (a) is a front view and (b) is an intermediate sectional view.

As shown in FIG. 2, an intermediary transfer belt unit 200 includes a driving roller 604, a tension roller 605 and an inner steering roller 603 which stretch the intermediary transfer belt 606 and move and drive the intermediary transfer belt 606 in an arrow R2 direction. In the intermediary transfer belt unit 200, the steering roller 605 is disposed upstream of a primary transfer surface of the intermediary transfer belt 606 on which the photosensitive drums 1*a*, 1*b*, 1*c* and 1*d* are disposed, and the driving roller 604 is disposed downstream of the primary transfer surface. The intermediary transfer belt 606 is a belt of a single layer of plural layers, including at least a resin belt formed of polyimide or the like as a base layer.

As shown in (a) and (b) of FIG. 3, a projected roller 617*a* is provided upstream of the photosensitive drums 1*a*, 1*b*, 1*c* and 1*d*, and a projected roller 617*b* is provided downstream of the photosensitive drums 1*a*, 1*b*, 1*c* and 1*d*. The projected rollers 617*a* and 617*b* prevent flappering of the primary transfer surface by tilting of the steering roller 605. At the inside surface of the intermediary transfer belt 606, the inner secondary transfer roller 603 is disposed. A belt motor 604M drives the driving roller 604 to rotate the intermediary transfer belt 606.

The steering roller 605 also functions as the tension roller for applying a predetermined tension to the intermediary transfer belt 606. Bearings 205*a* and 205*b* are urged outward by urging springs 611*a* and 611*b* incorporated in urging arms 202*a* and 202*b*. The steering roller 605 is urged outward at its both ends by the bearings 205*a* and 205*b* urged by the urging springs 611*a* and 611*b* to urge the inside surface of the intermediary transfer belt 606, thus applying the tension to the intermediary transfer belt 606.

The steering roller 605 tilts to adjust the rotational position of the intermediary transfer belt 602 with respect to the widthwise direction. A pair of front and rear urging arms 202*a* and 202*b* is mounted on an intermediary transfer belt unit frame 201, and the steering roller 605 is supported at its both ends by the bearings 205*a* and 205*b* provided on the urging arms 202*a* and 202*b*. The front urging arm 202*a* is rotatable about a shaft supporting point 204, and a rotation angle of the arm 202*a* is adjustable in an arrow S1 direction by a steering cam 203 capable of changing its rotation phase by a cam driving motor 203M.

A control portion 150 effects the lateral belt deviation control of the intermediary transfer belt 606. The control portion 150 controls the cam driving motor 203M on the basis of a signal of an edge detecting sensor 5 for detecting an end (edge) position of the intermediary transfer belt 606 to rotate the steering cam 203, so that the alignment of the steering roller 605 is changed in the arrow S1 direction.

<Lateral Belt Deviation Control>

FIG. 4 is a block diagram of a lateral belt deviation control constitution of the intermediary transfer belt. FIG. 5 is a flow chart of the lateral belt deviation control. FIG. 6 is an illustration of a first cam position. FIG. 7 is an illustration of a second cam position. FIG. 8 is an illustration of a rotational state of the intermediary transfer belt subjected to the lateral belt deviation control. In FIGS. 6 and 7, (a) shows the cam position and (b) is a perspective view of the intermediary transfer belt unit.

As shown in (a) of FIG. 3, the steering cam 203 is controlled in two stages including a cam position A in which the intermediary transfer belt 606 is shifted toward the front side and a cam position B in which the intermediary transfer belt 606 is shifted toward the rear side.

Incidentally, actually, it is desirable that a tilting angle of the steering roller 605 is set in an analog manner by changing the cam position depending on a detected amount of the lateral belt deviation. However, here, for simplifying the explanation, an example in which the tilting angle of the steering roller 605 is set in a digital manner will be described.

As shown (a) of FIG. 6, in the case where the cam position A is set, even when the disturbance corresponding to maximum lateral belt deviation which can occur in the intermediary transfer belt unit 200 occurs, the intermediary transfer belt 606 is shifted toward the front side. As shown in FIG. 7, in the case where the cam position B is set, even when the disturbance corresponding to the maximum lateral belt deviation which can occur in the intermediary transfer belt unit 200 occurs, the intermediary transfer belt 606 is shifted toward the rear side. Thus, even when there is a difference in alignment due to variation in disposing state of the image forming apparatus 100 or in roller parts, the tilting angle of the steering roller 605 is set with a margin so that the intermediary transfer belt 606 is always shifted in an assumed direction.

As shown in FIG. 5 with reference to FIG. 4, when a belt driving instruction is provided, the control portion 150 controls the cam driving motor 203M on the basis of a belt end position detected by the edge detecting sensor 5 to effect the lateral belt deviation control.

The control portion 150 obtains, when an operation of the image forming apparatus 100 is started and the belt driving instruction is inputted (S160), output information of the edge detecting sensor 5 and then judges whether or not the belt edge position reaches an allowance limit at the rear side (S161). In the case where the belt edge position reaches the rear-side allowance limit (Yes of S161), as shown in FIG. 6, the steering cam 203 is held at the cam position A (S162).

The control portion 150 judges, in the case where the belt edge position does not reach the rear-side allowance limit (No of S161), whether or not the belt edge position reaches a front-side allowance limit (S163). In the case where the belt edge position reaches the front-side allowance limit (Yes of S163), as shown in FIG. 7, the steering cam 203 is held at the cam position B (S164).

In the case where the belt edge position does not reach any of the rear-side and front-side allowance limits (No of S161 and No of S163), the control portion 150 still holds the steering cam 203 at the position during the input of the belt driving instruction. Thus, the control portion 150 actuates, after making initial setting of the steering cam 203, a belt driving motor 604M to start the rotation of the intermediary transfer belt 606 (S165).

This is because it is possible to prevent a large protrusion of the intermediary transfer belt 606 from the allowance limit position immediately after the actuation by performing a checking operation of the belt edge position and the steering cam position before the start of the drive of the belt driving motor 604M.

After the actuation of the belt driving motor 604M, the control portion 150 reads the signal from the edge detecting sensor 5 at a predetermined interval to effect the checking of the belt edge position. Then, in the case where the belt edge position reaches the allowance limit (Yes of S166), as shown in FIG. 6, the steering cam 203 is held at the cam position A and the intermediary transfer belt 606 is moved toward the front side (S167).

The control portion 150 judges, in the case where the belt edge position does not reach the rear-side allowance limit (No of S166), whether or not the belt edge position reaches the front-side allowance limit (S168). Then, in the case where the belt edge position reaches the front-side allowance limit (Yes of S168), as shown in FIG. 7, the steering cam 203 is held at the cam position B and the intermediary transfer belt 606 is moved toward the front side (S169).

The switching operation between the cam positions A and B is performed through during the rotation of the intermediary transfer belt 606 and when a belt stopping signal is inputted (S170), the belt driving motor 604M to end the lateral belt deviation control (S171).

Thus, in the case where the lateral belt deviation conveyance direction is effected, the belt edge position of the intermediary transfer belt 606 is, as shown in (a) of FIG. 8, reciprocally moved within a range between the front-side and rear-side allowance limits. An allowance range of the lateral belt deviation position of the intermediary transfer belt 606 is determined and reciprocal motion of the belt edge position is caused within the allowance range.

In such control, as the edge detecting sensor 5, it is possible to use a simple photo-interrupter for detecting only that the belt edge position reaches a predetermined position and therefore it is possible to prevent complete lateral belt deviation of the intermediary transfer belt 606 in a simple constitution.

Incidentally, in the lateral belt deviation correcting mechanism of the roller steering type, as described in JP-A 2000-264479, a contacting member contacted to and separated from the belt member causes the disturbance, so that the lateral belt deviation control becomes unstable in some cases. By applying alignment or contact pressure of the contacting member contactable to and separable from the belt member, the disturbance of the steering control by the contacting and separating operation is alleviated. In this case, however, a fluctuation in contact state with the recording material caused by the steering operation itself cannot bead dressed.

As shown in FIG. 22, as a dominant parameter for a conveyance state of the belt member and the recording material, there is a tilting angle $\alpha$ of the belt member and a tilting angle $\beta$, with respect to the conveyance direction, which is a movement locus of a material point on the belt member. In the lateral belt deviation control by the steering roller, the belt member tilting angle $\alpha$ is controlled by tilting the steering roller. The tilting angle $\alpha$ is a parameter which provides the steering roller with a belt incident angle and causes the lateral belt deviation. The belt member tilting angle $\alpha$ is irrespective of the movement of the material point of the belt member, so that an absolute value thereof does not act on the recording material. However, in a process in which the tilting angle $\alpha$ is changed, the tilting angle $\beta$ is transitionally changed in interrelation with the tilting angle $\alpha$. This is so-called slewing (swing) motion. Originally, in the steering operation, it is ideal that only the tilting angle $\alpha$ is controlled and the tilting angle $\beta$ is kept unchanged.

On the other hand, the parameter which directly contributes to the fluctuation in contact state between the belt member and the recording material is the tilting angle $\beta$ with respect to the conveyance direction. When the tilting angle $\beta$ is formed between the movement locus of the recording material which is constrained by the registration roller and moves while contacting the belt member surface and the movement locus of the material point on the belt member, at the contact portion with the recording material, frictional relative movement occurs correspondingly to the tilting angle $\beta$.

Depending on a stretch condition of the belt member and the arrangement of the steering roller and the recording material, the tilting angle $\beta$ at the recording material contacting portion changes in interrelation with the steering operation. At this time, in the case where a thrust force of constraint of the recording material is weak, the recording material is shifted in a thrust direction by a frictional force from the belt member. In the case where the recording material force of constraint is strong, the belt member is shifted in an opposite direction by reaction force. As a result, the complete lateral belt deviation of the belt member can be caused and a lowering in lateral belt deviation control gain can be caused. Further, in the case where the image is transferred from the belt member onto the recording material image distortion occurs.

Comparative Embodiment

FIG. 9 is an illustration of a structure of an intermediary transfer belt unit in Comparative Embodiment. Parts (a) and (b) of FIG. 10 are illustrations of transfer image distortion in Comparative Embodiment.

An intermediary transfer belt unit 200H in Comparative Embodiment has a conventional device constitution in which a registration device 65H is separately and independently provided and is fixed to an apparatus main assembly of the image forming apparatus 100. The constitutions of the steering roller 605, the steering control and the registration roller pair 302 are those described above and therefore will be omitted from detailed description.

As shown in FIG. 10, in the case where image formation is effected with the above-described lateral belt deviation control by using the intermediary transfer belt unit in Comparative Embodiment, it was found that the toner image secondary-transferred onto the recording material P caused the distortion.

As shown in (a) of FIG. 6, in the case where the image formation was effected when the steering cam 203 was located at the cam position A, it was turned out that the conveyance direction of the intermediary transfer belt 606 is shifted toward the front side and was changed in an arrow R2' direction. For this reason, scanning lines were secondary transferred obliquely onto the recording material P which was constrained by the registration device 65H and was conveyed in the arrow R2 direction.

Further, during the constraint on the downstream side of the recording material P by the registration device 65H, frictional slip with respect to the scanning line direction occurs between the intermediary transfer belt 606 and the recording material P, so that edges of the scanning lines are uniformly aligned in a rectilinear line. However, after the recording material P starts to release from the constraint by the registration device 65H, the recording material P is drawn in the arrow R2' direction and as shown in (a) of FIG. 10, the image is distorted.

As shown in (a) of FIG. 7, when the steering cam 203 was located at the cam position B, it was turned out that the conveyance direction of the intermediary transfer belt 606 is shifted toward the rear side and was changed to an arrow R2" direction. For that reason, after the recording material P starts to release from the constraint by the registration device 65H, the recording material P is drawn in the arrow R2" direction and as shown in (b) of FIG. 10, the image is distorted.

In the case of the registration device 65H fixed to the image forming apparatus main assembly, the recording material P is always conveyed in a certain direction following the registration device 65H. For this reason, at the secondary transfer portion T2, a deviation in conveyance direction occurs between the intermediary transfer belt 606 and the recording material P. In an area in which the registration device 65H is gripped by the registration roller pair 302, the conveyance direction of the recording material P is controlled by the registration device 65H.

However, in the case where a loop of the recording material P between the registration roller pair 302 and the steering portion T2 becomes large or after the recording material P passes through the registration roller pair 302, the recording material P is strongly controlled and conveyed by the transfer belt 606. For this reason, at the secondary transfer portion T2, the image distortion occurs as shown in FIG. 10.

The reason why the conveyance direction of the intermediary transfer belt 606 is shifted by the steering operation is, as described later, that one end of the steering roller 605 is horizontally retracted by the tilting of the steering roller 605 in the vertical direction and is that the one end of the steering roller 605 is pushed toward the inside by the intermediary transfer belt 606 having a certain circumferential length.

Therefore, in the following embodiments, the conveyance direction of the intermediary transfer belt 606 and the conveyance direction of the recording material P are caused to be the same as each other by shifting both ends of the registration device 65H in an amount corresponding to that of both ends of the steering roller 605 with respect to the horizontal direction.

Embodiment 1

FIG. 11 is an illustration of elimination of the transfer image distortion in Embodiment 1. As shown in FIG. 2, the intermediary transfer belt unit 200 is provided with the registration device 65 tilted in interrelation with tilting of the steering roller 605. The steering roller 605 and the registration device 65D are connected by the wires 207*a* and 207*b* to which the tension is applied from unit urging springs 309*a* and 309*b*. The registration device 65 is rotated in the flat surface of the intermediary transfer belt 606 to change the tilting angle with respect to the movement direction of the intermediary transfer belt 606.

As shown in (a) and (b) of FIG. 11, front and rear unit plates 305 and 306 of the registration device 65 integrally support the registration roller pair 302 and the conveying guides 307 and 308 which are used to send the recording material P to the secondary transfer portion T2. The registration device 65 press-contacts an upper registration roller 301*a* which is a metal roller and a lower registration roller 301*b* having a surface layer of a rubber material to form a conveyance nip between the registration roller pair 302.

The oblique movement correction and timing correction of the recording material P are made by rotationally driving the registration roller pair 302 intermittently. The recording material P is abutted against the conveyance nip in a state in which the registration roller pair 302 is stopped, so that the oblique movement is corrected. Thereafter, the registration roller pair 302 is rotationally driven with predetermined timing, so that the recording material P is conveyed to the secondary transfer portion T2 so as to position the image at a predetermined transfer position on the recording material P.

The registration device 65 is supported by the intermediary transfer belt unit 200 by dowels 303*a* and 304*a* of the front plate of an intermediary unit frame 201 and dowels (303*b* and 30*b* (not shown)) of the rear plate. The dowels 303*a* and 304*a* are held (supported) by elliptical holes of the front unit plate 305 of the registration device 65, and the dowels 303*b* and 304*b* are supported by elliptical holes of the rear unit plate 306.

The front and rear unit plates 305 and 306 are slidably supported and therefore the registration device 65 is rotationally moved in the flat surface of the intermediary transfer belt 606, so that the tilting angle with respect to the movement direction of the intermediary transfer belt 606 is changeable.

Between the front unit plate 305 and the intermediary unit frame 201, a unit urging spring 309*a* is stretched to urge the front unit plate 305 toward the driving roller 604 in an arrow S3 direction. Between the rear unit plate 306 and the intermediary unit frame 201, a unit urging spring (309*a* (not shown)) is stretched to urge the rear unit plate 306 toward the driving roller 604 in the arrow S3 direction.

The bearings 205*a* and 205*b* for supporting the both ends of the steering roller 605 and provided with wire hooking projections 206*a* and 206*b* correspondingly to winding start phase positions of the intermediary transfer belt 606 with respect to the steering roller 605. The wire hooking projections 206*a* and 206*b* has cross-sectional positions corresponding to the winding start phase positions of the intermediary transfer belt 606 with respect to the steering roller 605.

The front unit plate 305 of the registration device 65 is provided with a wire hooking dowel 310*a*, and the rear unit plate is provided with a wire hooking dowel 310*b*. At the front side, a wire 207*a* is stretched in a predetermined length between the wire hooking projection 206*a* and the wire hooking dowel 310*a*. At the rear side, a wire 207*b* is stretched in a predetermined length between the wire hooking projection 206*b* and the wire hooking dowel 310*b*. The wires 207*a* and 207*b* hooked on the wire hooking projections 206*a* and 206*b* are extended and stretched to the registration device 65 in a shape substantially along the stretching of the intermediary transfer belt 606.

That is, the wire hooking projections 206*a* and 206*b* fix one ends of the wires 207*a* and 207*b* at an outer diameter position of the steering roller 605 corresponding to the winding start position of the intermediary transfer belt 606 with respect to the steering roller 605. Further, the wires 207*a* and 207*b* are guided by a pulley having the same diameter as that of the inner secondary transfer roller to provide a locus which overlaps with the edge of the intermediary transfer belt 606 and are fixed to the wire hooking dowels 310*a* and 310*b* at the other ends.

By stretching the wires 207*a* and 207*b* in the above-described manner, the line of start of the winding of the intermediary transfer belt 606 about the steering roller 605 and the registration device 65 (secondary transfer nip) are always kept in parallel. When the direction in which the steering roller 605 guides the intermediary transfer belt 606 is changed, the direction in which the steering roller 605 feeds the recording material is immediately changed. The tilting (direction and magnitude) of the intermediary transfer belt 606 with respect to the movement direction by the tilting of the secondary transfer steering roller 605 is set as it is as the tilting of the registration device 65 with respect to the conveyance direction.

As a result, the difference in angle, generated by the tilting motion of the steering roller 605, between the movement direction of the intermediary transfer belt 606 and the recording material feeding direction of the registration device 65 is cancelled with no excess and no deficiency. Strictly speaking, the winding start position of the intermediary transfer belt 606 is moved by the tilting of the steering roller 605, so that an error in magnitude of set tilting can occur but this is normally of ignorable level.

The tension of the urging springs 611*a* and 611*b* for applying tension to the intermediary transfer belt 606 is set to be larger than that of the unit urging springs 309*a* and 309*b*. For this reason, the registration device 65 is supported in the intermediary transfer belt unit 200 at a position in which the intermediary transfer belt 606 and the wire 207 are stretch with no looseness.

As shown (a) of FIG. 6, in order to shift the intermediary transfer belt 606 toward the front side, when the steering cam 203 is located at the cam position A (first cam position), the conveyance direction of the intermediary transfer belt 606 is changed to the arrow R2' direction. At this time, the both ends of the registration device 65 are moved by the wires 207*a* and 207*b* in the amount equal to the amount of the horizontal movement of the steering roller 605, so that the conveyance direction of the recording material P is uniformized in the arrow R2' direction.

In the state of the cam position A, correspondingly to the tilting of the steering roller 605, the wire hooking projections 206*a* and 206*b* provided on the bearings 205*a* and 205*b* are tilted to tow the wires 207*a* and 207*b*. By this towing of the wires, the registration device 65 is tilted and held, as shown in (b) of FIG. 6, in a state corresponding to the tilting of the steering roller 605. Then, the conveyance direction of the recording material P from the registration roller pair 302 is changed to a direction which substantially is the same as the conveyance direction of the intermediary transfer belt 606.

For this reason, also during the constraint by the registration device 65 and also after the constraint by the registration device 65 is started to be released, the conveyance direction of the intermediary transfer belt 606 and the conveyance direction of the recording material P are continuously the same as each other. As a result, the frictional slip with respect to the scanning line direction does not occur between the intermediary transfer belt 606 and the recording material P, so that the image free from the distortion was obtained as shown in (a) of FIG. 11.

As shown (a) of FIG. 7, in order to shift the intermediary transfer belt 606 toward the rear side, when the steering cam 203 is located at the cam position B (second cam position), the conveyance direction of the intermediary transfer belt 606 is changed to the arrow R2" direction. At this time, the both ends of the registration device 65 are moved by the wires 207*a* and 207*b* in the amount equal to the amount of the horizontal movement of the steering roller 605, so that the conveyance direction of the recording material P is uniformized in the arrow R2" direction.

In the state of the cam position B, the conveyance direction of the registration device 65 is changed to the opposite direction as shown in (b) of FIG. 7 and the conveyance direction of the recording material P is changed to a direction which is substantially is the same as the conveyance direction of the intermediary transfer belt 606.

For this reason, the conveyance direction of the intermediary transfer belt 606 and the conveyance direction of the recording material P are continuously the same as each other. As a result, the frictional slip with respect to the scanning line direction does not occur between the intermediary transfer belt 606 and the recording material P, so that the image free from the distortion was obtained as shown in (b) of FIG. 11.

<Tilting of Belt Conveyance Direction with Steering Operation>

FIG. 12 is an illustration of a locus of an end portion of a steering roller with tilting. FIG. 13 is an enlarged view of the locus of the steering roller end portion. FIG. 14 is an illustration of an ideal belt movement direction. FIG. 15 is an illustration of an actual belt movement direction. FIG. 16 is an illustration of a belt winding state about the steering roller. Parts (a) and (b) of FIG. 17 are illustrations of a non-slip condition between the steering roller and the belt. Parts (a) and (b) of FIG. 18 are illustrations of a slip condition between the steering roller and the belt. FIGS. 14 and 15 are the illustrations corresponding to top plan views of the stretching layout of FIG. 12 (sectional view) and show the towing surface by the steering roller 113.

As shown in FIG. 12, as an ordinary stretching layout of an endless belt 114, the endless belt 114 is stretched and extended around four rollers. The four rollers include a steering roller 113, and the other three rollers are called stretching rollers 111 and 112, and a driving roller 110.

The endless belt 114 has a high Young's modulus, and expansion and contraction thereof is substantially negligible. In the case where the positions of the three rollers other than the steering roller 113 is fixed, the layout range of the steering roller 113 is limited to a range satisfying the condition of L1+L2=constant shown in FIG. 12, that is, on an elliptic orbit c having points of focus at the stretching rollers 111 and 112. This is because the elongation of the belt having the high Young's modulus is so small that the constant belt circumferential length in the stretching section is limiting.

As shown in FIG. 13 in an enlarged manner, the steering roller 113 functions as a tension roller for applying desired tension to the endless belt 114 by an urging means such as spring and is movable in an expansion and contraction direction of the urging means 120. Further, an unshown actuator moves a shaft end of the steering roller 113 in an arrow S direction to change shaft alignment. Specifically, a steering roller front end 113F and a steering roller rear end 113R are moved in opposite directions along the arrow S direction to provide a tilting (inclination) angle to the steering roller 113.

Actually, however, the front end and the rear end of the steering roller are moved (corrected) to the positions 113F' and 113R', respectively, by the expansion and contraction action of the urging means 120 because of the confining condition of the above-described elliptic orbit c. The change of the axis alignment provided by the correction provides the tilting of the belt conveyance direction.

Here, as shown in FIG. 14, the tilting angle of the endless belt 114 is $\alpha$ and as shown in FIG. 15, the tilting angle with respect to the belt conveyance direction (the tilting of the movement locus of the material point on the belt) is $\beta$. As shown in FIG. 14, the steering operation ideally changes the tilting angle α of the endless belt 114. However, actually, the endless belt 114 constrains the tension roller (steering roller) 113 and therefore as shown in FIG. 15, the tilting angle β with respect to the belt conveyance direction is also changed by the steering operation.

In FIGS. 14 and 15, the endless belt 114 is moved and driven in an arrow V direction, and the solid lines show the stretching attitude at time t, and the broken lines show the stretching attitude at time t+Δt. Here, it is supposed that the end position of the endless belt 114 is measured at two measurement points M1 and M2 arranged in the conveyance direction (the conveyance speed is taken as the distance between points M1 and M2 per time Δt). FIG. 14 is based on the assumption that the steering roller 113 is tilted in the direction of S (FIG. 13) only, and the endless belt 114 travels in the direction of X with the tilting angle α. At this time, the end portion is disposed in the Y direction at the measurement points M1 and M2, so that the lateral belt deviation occurs. However, as a material (mass)point Pt on the towing surface at time t is traced, it is at Pt+Δt aligned in the X direction at the time of t+Δt, and therefore, the material point per se does not displace in the Y direction.

Actually, however, the steering roller 113 is tilted in the S direction as shown in FIG. 13, and is simultaneously corrected to the elliptic locus, and therefore, two changes occur in the stretching attitude with the tilting angle α and the conveyance direction with the tilting angle β as shown in FIG. 15. As a result, in the duration from t to t+Δt, not only the displacement in the Y direction at the measurement points M1 and M2, i.e., the lateral belt deviation, but also the displacement in the Y direction of the material point Pt per se occur.

As shown in FIG. 15, when conveyance direction vectors V1, V2 of the downstream roller 110 and the upstream roller 113 for one stretching surface become different as described above, the conveyance direction of the material point of the stretching surface is controlled by the vector V1.

$$V=V1 \quad (1).$$

The reason will be described. The confining force to the belt by a roller stretching the belt is expressed by an Euler's formula as follows. As shown in FIG. 16, when the tension T1 of the belt member to the roller at the winding end side, the tension T2 at the winding start side, and a force F on the peripheral surface generated by the roller driving force or load are generated, the following formula is satisfied from the force balance when the belt and the roller rotate integrally:

$$T1+F=T2 \quad (2).$$

(F is positive when roller drives, and is negative when roller receives load).

The belt tension T' at angle θ which is a winding angle of the winding portion from the winding start point to the winding end point is, in the case where F is positive, expressed by the Euler's formula:

$$T'=T1\times e^{\mu\theta} \quad (3)$$

where μ is a static friction coefficient between the belt and the roller.

When F is negative, $$T'=T1\times e^{-\mu\theta} \quad (4)$$

When the winding angle of the belt member about the roller is θ, in the case where F is positive as shown in (a) of FIG. 17, the condition under which the belt and the roller can rotate integrally without slip is:

$$T1\times e^{\mu\theta r}>T2 \quad (5)$$

Or, in the case where F is negative as shown in (b) of FIG. 17, the following formula is satisfied.

$$T1\times e^{-\mu r}<T2 \quad (6)$$

In (a) of FIG. 17, when an angle at which the tension of the belt wound about the roller is T2 is θp, the tension changes in accordance with the Euler's formula within the winding range of 0 to θp degrees. However, in the case where the friction coefficient μ is large and the winding angle θr is sufficiently large, the tension is equal to T2 at θp. The region to this point is a range in which the belt member is conveyed. Within the region from the θp to the θr, the tension is constant at T2, and such a range is a margin for the above conveyance.

On the other hand, in the case where the μ is small or θr is not sufficiently large, a distribution of the tension is formed as shown in FIG. 18, a slip occurs between the belt and the roller. The tension change in the range of the winding of the belt member does not reach a value for a balance with the driving force or the load, and therefore, the balance of the forces is destroyed, so that slip movement occurs between the belt and the roller.

Referring to the example of FIG. 12, the reason why the conveyance direction vector V of the stretching surface is controlled by the conveyance direction vector of the stretching surface downstream roller as expressed by equation (1).

As shown in (a) of FIG. 17, there is a region (0≤θ≤θp) from the winding end point with respect to the conveyance direction determined by the Euler's formula to the angle θp. In such a region, the tension changes as expressed by equations (3) and (4), and this shows that the driving force and the load are transmitted by the maximum static friction force between the roller and the belt.

For this reason, in the case an external disturbance force is supplied to the belt tension T1 at the roller downstream side, in this region, the disturbance force immediately exceeds the maximum static friction force to cause minute slip. When the slip occurs, the tension in the range upstream of θp changes under the control of the Euler's formula to resists the disturbance, and after the disturbance disappears, the previous states is reestablished.

On the other hand, the disturbance is supplied to the tension T2 at the roller upstream side, the disturbance enters from the winding portion upstream of θp. This region (θp≤θ≤θr) does not contribute to the transmission of the driving force or the load between the belt and the roller and therefore the frictional force acting between the roller and the belt has a margin to the maximum static friction force. For this reason, no slip occurs between the roller and the belt against the disturbance force from the roller upstream side.

When a difference is produced between the upstream conveyance direction vector V2 and the downstream conveyance direction vector V1 on the stretching surface as shown in FIG. 15, the disturbance force to the winding portion of each roller about the roller because the high Young's modulus belt such as a resin material belt cannot deform within the belt member surface.

In such a case, the disturbance force is inputted to the region θp≤θ≤θr of the downstream side roller on the stretching surface and therefore that feeding direction vector V2 can be maintained against the disturbance force. However, the disturbance is inputted to the region 0≤θ≤θp of the upstream roller on the stretching surface, so that the minute slip occurs and the emergent direction of the belt cannot maintain V2, and thus the direction of the vector V2 follows the V1 direction of the downstream roller.

As described above, the conveyance direction vector on the stretching surface of the belt member is controlled by the conveyance direction vector V1 of the roller having the region of $\theta p \leq \theta \leq \theta r$ at the downstream side on the stretching surface.

Belt Conveyance Direction in Embodiment 1

As shown in FIGS. 6 and 7, in the intermediary transfer belt unit 200 in Embodiment 1 in which the steering roller also functions as the tension roller, the conveyance direction of the material point on the stretching surface of the intermediary transfer belt 606 is changed with the steering operation. When the steering arm 202*a* is rotationally moved to perform the steering operation, as shown in FIG. 12, the front end portion of the steering roller 603 (111) is disposed on a substantially elliptical orbit with the projected roller 617*a* (112) as a focus.

At this time, based on the mechanism described with reference to FIGS. 12 to 15, the belt conveyance direction by the steering roller 605 is tilted with respect to other directions. However, based on the mechanism described with reference to FIGS. 16 to 18, the conveyance direction of the primary transfer surface is controlled by the driving roller 604 located downstream of the stretching surface with a sufficient degree of winding. For this reason, as shown in (b) of FIG. 8, there is substantially no fluctuation in tilting of the belt conveyance direction by the steering operation. Therefore, on the primary transfer surface on which the respective color toner images are transferred onto the intermediary transfer belt 606, good primary transfer of the toner images is effected with no relative positional deviation of each of the images.

On the other hand, the secondary transfer surface including the secondary transfer portion T2 has a sufficient degree of winding, and the downstream roller on the stretching surface is the steering roller 605 tilted by the steering operation. For this reason, as shown in (c) of FIG. 8, the tilting of the belt conveyance direction largely changes with the steering operation.

For this reason, in the intermediary transfer belt unit 200H in Comparative Embodiment shown in FIG. 9, a good secondary transfer image cannot be obtained as shown in FIG. 10. However, in the intermediary transfer belt unit 200 in Embodiment 1 shown in FIG. 2, the conveyance direction of the recording material P by the registration device 65 is changed correspondingly to the change in tilting of the belt conveyance direction shown in (c) of FIG. 8 and therefore the good secondary transfer image can be obtained.

As described above, in the image forming apparatus in Embodiment 1, it is possible to realize good image transfer with a simple constitution in the primary transfer and the secondary transfer. The contact portion frictional force due to the difference in movement locus of the material point, caused by the steering operation, between the image bearing member and another image bearing member at the transfer portion can be reduced. It is also possible to simultaneously improve a control SN ratio in the lateral belt deviation control and accuracy of the transfer image. Further, high quality image output in the image forming apparatus can be realized.

Embodiment 2

Parts (a) and (b) of FIG. 19 are illustrations of an intermediary transfer belt unit in Embodiment 2. FIG. 20 is a block diagram of a lateral belt deviation control constitution in Embodiment 2. FIG. 21 is a flow chart of the lateral belt deviation control in Embodiment 2. In this embodiment, the image forming apparatus constitution, the recording material conveying process, the full-color image forming process, the secondary transfer process and subsequent processes are identical to those in Embodiment 1 and therefore in FIGS. 19 and 21, reference numerals or symbols similar to those in FIGS. 2 to 5 are used and will be omitted from redundant description.

As shown in (a) and (b) of FIG. 19, in this embodiment, the registration device 65B for changing the recording material conveyance direction in interrelation with the tilting motion of the steering roller 605 is incorporated into the intermediary transfer belt unit 200B.

The steering roller 605 also functions as the tension roller. The bearings 702*a* and 702*b* for supporting both end portions of the steering roller 605 are slidably supported along the steering arms 202*a* and 202*b* and are urged toward the outside by the urging springs 611*a* and 611*b*.

The bearings 702*a* and 702*b* are provided with flags 703*a* and 703*b*, and roller position detecting sensors 704*a* and 704*b* for detecting the position of the flags 703*a* and 703*b* are provided above the steering arms 202*a* and 202*b*.

The registration device 65B, similarly as in Embodiment 1, capable of adjusting the conveyance direction of the recording material sent to the secondary transfer portion T2 by changing the alignment with respect to the intermediary transfer belt unit 200B. The front plate of the registration device 65B can adjust the tilting angle of the conveyance direction in an arrow S5 direction by the action of an alignment adjusting cam 705 provided on the intermediary transfer belt unit 200B.

As shown in FIG. 21 with reference to FIG. 20, the control portion 150 effects the lateral belt deviation control (steering control) of the intermediary transfer belt 606 as described in Embodiment 1 with reference to the flow chart of FIG. 5. Then, the control portion 150 contacts a cam driving motor 705M in interrelation with the lateral belt deviation control to control the alignment changing operation of the registration device 65B.

To the control portion 150, when the operation of the image forming apparatus 100 is started and a belt driving instruction is inputted (S800), information from the roller position detecting sensor 704 and retaining position information on the steering cam 203 are inputted (S801).

The control portion 150 computes, on the basis of these pieces of information, the tilting angle of the conveyance direction on the secondary transfer stretching surface generated by the steering roller and then computes an alignment adjusting amount for adjusting the alignment of the registration device 65B so as to be the same as the tiling angle (S802).

The control portion 150 changes, on the basis of the computation result, the rotational position of the alignment adjusting cam 705 to move the registration device 65B to the position with a suitable tilting angle within the flat plane (S803). This operation is repeated during the operation of the belt but when the belt stop signal is inputted (S804), the belt driving roller 604 is stopped and the control is ended (S805).

In this way, even when the fluctuation in unit alignment with time or the like is caused, the conveyance direction of the recording material P conveyed from the registration device 65B can be made the same as the conveyance direction of the intermediary transfer belt 606 at all times, so that it is possible to always realize the good image transfer in the primary transfer and the secondary transfer.

Embodiment 3

FIG. 23 is an illustration of a structure of an image forming apparatus in Embodiment 3. In Embodiment 1, the intermediary transfer belt is used as the belt member and the recording material is used as the contact member which generates the disturbance, but the belt member may also be another image bearing member such as a photosensitive member belt or another recording material conveying member such as a secondary transfer belt.

As shown in FIG. 23, at the transfer portion T1, the toner image is transferred onto the recording material P in a process in which the recording material P is continuously conveyed on a recording material conveyer belt 606E as an example of the belt member. The registration device 65E as an example of the recording material supplying means conveys and supplies the recording material P to the transfer portion T1. The steering roller 605 is tilted to control the widthwise rotational position of the recording material conveyer belt 606E. An adjusting mechanism 20E adjusts the conveyance direction of the recording material P by the registration device 65E in interrelation with the tilting motion of the steering roller 605 so as to be adapted to the tilting angle of the conveyance direction of the recording material conveyer belt 606E generated by the tilting motion of the steering roller 605.

Embodiment 4

FIG. 24 is an illustration of a structure of an image forming apparatus in Embodiment 4. In Embodiment 1, the steering roller also functions as the toner roller but in this embodiment the steering roller 605 and a tension roller 620 are separate members.

As shown in FIG. 24, at the secondary transfer portion T2, the toner image is secondary-transferred onto the recording material P in a process in which the recording material P is continuously conveyed on an intermediary transfer belt 606F as an example of the belt member. A registration device 65F as an example of the recording material supplying means conveys and supplies the recording material P to the secondary transfer portion T2. The steering roller 605 is tilted to control the widthwise rotational position of the intermediary transfer belt 606F. An adjusting mechanism 20F adjusts the conveyance direction of the recording material P by the registration device 65F in interrelation with the tilting motion of the steering roller 605 so as to be adapted to the tilting angle of the conveyance direction of the intermediary transfer belt 606F generated by the tilting motion of the steering roller 605.

In the image forming apparatus 100F, with the tilting motion of the steering roller 605, the intermediary transfer belt 606F constrains the tension roller 620 to horizontally move the tension roller 620. As a result, as shown in FIG. 15, at the secondary transfer portion T2 located upstream of the steering roller 605 with respect to the conveyance direction of the intermediary transfer belt 606F, the tilting angle β is generated with respect to the conveyance direction of the intermediary transfer belt 606F. The adjusting mechanism 20F sets the tilting angle β every moment in the registration device 65F, so that the belt member movement direction and the recording material conveyance direction are caused to be continuously the same as each other.

As described above, according to the present invention, even when the tilting state of the steering roller is changed, a degree of the deviation between the belt member conveyance direction and the recording material supply direction can be reduced to suppress the disturbance of the transfer image.

In the image forming apparatus of the present invention, the recording material conveyance direction is adjusted by the recording material supplying means so as to be adapted to the tilting of the belt member conveyance direction generated by the tilting motion of the steering roller.

Therefore, the disturbance to the rotation of the belt member when the recording material is supplied to the transfer portion is constantly reproduced, so that unstable belt movement is not caused. Thus, even in simple control, the steering control can be stably carried out with high accuracy. Further, even when the tilting state of the steering roller is changed, the degree of deviation between the belt member conveyance direction and the recording material supply direction can be reduced to prevent the disturbance of the transfer image.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 224329/2010 filed Oct. 1, 2010, which is hereby incorporated by reference.

What is claimed is:

1. An image forming apparatus comprising:

a movable belt member;

a toner image forming unit configured to form a toner image on said belt member;

a transfer portion where the toner image formed on said belt member is to be transferred onto a recording material;

a steering roller configured to stretch said movable belt member and configured to adjust a position of said movable belt member with respect to a widthwise direction crossing a moving direction of said movable belt member to change the moving direction of said movable belt member;

a tilting mechanism configured to tilt said steering roller;

a detecting member configured to detect a position of said movable belt member with respect to the widthwise direction;

a control portion configured to control said tilting mechanism based on an output of said detecting member;

a recording material supplying unit configured to supply the recording material to said transfer portion, and configured to be movable to change a conveyance direction of the recording material; and a connecting member configured to connect said steering roller and said recording material supplying unit so that the conveyance direction of the recording material is changed correspondingly to the moving direction of said movable belt member at said transfer portion changed by said steering roller.

2. An image forming apparatus according to claim 1, wherein said connecting member includes a wire.

3. An image forming apparatus according to claim 2, wherein the wire connects an end portion of said steering roller and an end portion of said recording material supplying unit with respect to the widthwise direction, and wherein the end portion of said recording material supplying unit is moved with movement of the end portion of said steering roller by tilting of said steering roller.

4. An image forming apparatus according to claim 1, further comprising a frame configured to support said steering roller, wherein said recording material supplying unit is movably supported by said frame, and wherein an urging member is provided between said frame and said recording material supplying unit.

5. An image forming apparatus according to claim 4, wherein when the urging member is a first urging member, said image forming apparatus further comprises a second urging member configured to impart tension to said belt member, and wherein an urging force of the second urging member is larger than the urging force of the first urging member.

6. An image forming apparatus according to claim 5, wherein the second urging member imparts tension to said belt member by urging said steering roller.

7. An image forming apparatus according to claim 1, wherein said steering roller is provided upstream of said toner image forming unit and downstream of said transfer portion with respect to the moving direction of said movable belt member.

8. An image forming apparatus according to claim 1, wherein said movable belt member includes a resinous single layer or resinous plural layers.

9. An image forming apparatus comprising:

a movable belt member;

a toner image forming unit configured to form a toner image on said movable belt member;

a transfer portion where the toner image formed on said movable belt member is to be transferred onto a recording material;

a steering roller configured to stretch said movable belt member and configured to adjust a position of said movable belt member with respect to a widthwise direction crossing a moving direction of said movable belt member to change the moving direction of said movable belt member;

a tilting mechanism configured to tilt said steering roller;

a detecting member configured to detect a position of said movable belt member with respect to the widthwise direction;

a control portion configured to control said tilting mechanism based on an output of said detecting member;

a recording material supplying unit configured to supply the recording material to said transfer portion;

a changing mechanism configured to change a conveyance direction of the recording material supplied by said recording material supplying unit; and an adjusting portion configured to adjust said changing mechanism so that the conveyance direction of the recording material is changed correspondingly to the moving direction of said belt member at said transfer portion changed by said steering roller.

10. An image forming apparatus according to claim 9, wherein each of said tilting mechanism and said changing mechanism includes a cam member and a cam drive member.

11. An image forming apparatus according to claim 9, wherein said movable belt member includes a resinous single layer or resinous plural layers.

* * * * *